US006160520A

United States Patent [19]

Muhlhauser et al.

[11] Patent Number: 6,160,520

[45] Date of Patent: Dec. 12, 2000

[54] DISTRIBUTED BIFOCAL ABBE-SINE FOR WIDE-ANGLE MULTI-BEAM AND SCANNING ANTENNA SYSTEM

[75] Inventors: Nicholas L. Muhlhauser; Kenneth P. Cannizzaro, both of Los Gatos; Brian C. Hewett, Los Altos, all of Calif.

[73] Assignee: E★Star, Inc., Los Gatos, Calif.

[21] Appl. No.: 09/273,466

[22] Filed: Mar. 22, 1999

Related U.S. Application Data

[63] Continuation-in-part of application No. 09/004,759, Jan. 8, 1998, and a continuation-in-part of application No. 09/110,687, Jul. 7, 1998.

[51] Int. Cl.[7] ..... H01Q 19/10

[52] U.S. Cl. ..... 343/755; 343/775; 343/779

[58] Field of Search ..... 343/755, 754, 343/753, 772, 775, 776, 779, 781 R, 781 P, 781 GA; H01Q 19/10, 19/14

[56] References Cited

U.S. PATENT DOCUMENTS

| | | | |
|---|---|---|---|
| 2,682,610 | 6/1954 | King | 343/772 |
| 2,735,092 | 2/1956 | Brown, Jr. | 343/772 |

(List continued on next page.)

FOREIGN PATENT DOCUMENTS

| | | |
|---|---|---|
| 0682383 | 11/1995 | European Pat. Off. . |
| 0553707 | 5/1996 | European Pat. Off. . |
| 55-454476 | 11/1981 | Japan . |
| 57-696621 | 11/1983 | Japan . |
| 9416472 | 7/1994 | WIPO . |

OTHER PUBLICATIONS

"Array Antenna Composed of 4 Short Axial–Mode Helical Antennas" by Shiokawa, et al.

"A Study of the Sheath Helix with a Conducting Core and its Application to the Helical Antenna" by Neureuther, et al., IEEE, Transactions on Antennas and Propagation, vol. AP–15, No. 2, Mar. 1967.

"Wave Propagation on Helices" IEEE Transactions on Antennas and Propagation, vol. AP–28, No. 2, Mar. 1980.

"Short Helical Antenna Array Fed From a Waveguide" by Nakano, et al., IEEE, 1984.

"Radiation from a Sheath Helix Excited by a Sheath Waveguide: a Wienor–Hopf Analysis" by Fernandes, IEEE, Oct. 1990.

"Low–Profile Helical Array Antenna Fed From A Radical Waveguide" by Nakano, et al., IEEE, 1992.

"Wave Propagation on Helical Antennas" by Cha, IEEE, Sep., 1972.

(List continued on next page.)

*Primary Examiner*—Hoanganh Le

*Attorney, Agent, or Firm*—Liniak, Berenato, Longacre & White

[57] ABSTRACT

A multiple beam antenna system including a reflector that is at least partially parabolic in one dimension, a pair of dielectric lenses (or optionally at least one shaped reflector to perform functionality otherwise performed by the lens (es)), and a pair of waveguides. Multiple received beams are received and reflected by the reflector into an orthogonal mode junction which separates signals of a first polarity from signals of a second orthogonal polarity. The signals of the first polarity are forwarded into a first waveguide and the orthogonal signals of the second polarity are forwarded into a second parallel waveguide. A plurality of satellites may be accessed simultaneously thus allowing the user to utilize both signals at the same time. In certain embodiments, each of the dielectric lenses may be of the bifocal type.

18 Claims, 21 Drawing Sheets

U.S. PATENT DOCUMENTS

| | | | |
|---|---|---|---|
| 2,816,271 | 12/1957 | Barker | 343/772 |
| 2,847,672 | 8/1958 | Giffin et al. | 343/895 |
| 2,863,148 | 12/1958 | Gammon et al. | 343/895 |
| 2,934,762 | 4/1960 | Smedes | 343/754 |
| 2,953,781 | 9/1960 | Donnellan et al. | 343/895 |
| 2,977,594 | 3/1961 | Marston et al. | 343/756 |
| 2,982,959 | 5/1961 | Hanneken | 343/724 |
| 3,017,633 | 1/1962 | Marston et al. | 343/895 |
| 3,135,960 | 6/1964 | Kaiser, Jr. | 343/858 |
| 4,427,984 | 1/1984 | Anderson | 343/764 |
| 4,467,294 | 8/1984 | Janky et al. | 333/126 |
| 4,467,329 | 8/1984 | Thal, Jr. | 343/909 |
| 4,494,117 | 1/1985 | Coleman | 343/895 |
| 4,511,868 | 4/1985 | Munson et al. | 333/257 |
| 4,584,588 | 4/1986 | Mohring et al. | 343/756 |
| 4,647,938 | 3/1987 | Roederer et al. | 343/756 |
| 4,660,050 | 4/1987 | Phillips | 343/753 |
| 4,680,591 | 7/1987 | Axford et al. | 343/853 |
| 4,785,302 | 11/1988 | Ma et al. | 342/362 |
| 4,791,428 | 12/1988 | Anderson | 343/758 |
| 4,845,507 | 7/1989 | Archer et al. | 343/754 |
| 4,920,351 | 4/1990 | Barlett et al. | 343/756 |
| 5,041,842 | 8/1991 | Blaese | 343/882 |
| 5,053,786 | 10/1991 | Silverman et al. | 343/895 |
| 5,061,943 | 10/1991 | Rammos | 343/770 |
| 5,117,240 | 5/1992 | Anderson et al. | 343/786 |
| 5,146,234 | 9/1992 | Lalezari | 343/895 |
| 5,227,807 | 7/1993 | Bohlman et al. | 343/895 |
| 5,243,358 | 9/1993 | Sanford et al. | 343/836 |
| 5,255,004 | 10/1993 | Berkowitz et al. | 343/853 |
| 5,258,771 | 11/1993 | Praba | 343/895 |
| 5,345,248 | 9/1994 | Hwang et al. | 343/895 |
| 5,359,336 | 10/1994 | Yoshida | 343/756 |
| 5,495,258 | 2/1996 | Muhlhauser et al. | 343/753 |
| 5,528,717 | 6/1996 | Schwering et al. | 385/129 |
| 5,619,173 | 4/1997 | King et al. . | |
| 5,652,597 | 7/1997 | Caille . | |
| 5,686,923 | 11/1997 | Schaller . | |
| 5,831,582 | 11/1998 | Muhlhauser et al. | 343/753 |

OTHER PUBLICATIONS

"Review of Radio Frequency Beamforming Techniques for Scanned and Multiple Beam Antennas" by Hall, et al, IEEE, Oct. 1990.

"Design Trades for Rotman Lenses" by Hansen, IEEE, 1991.

"Design of Compact Low–Loss Rotman Lenses" by Rogers, IEEE, Oct. 1987.

"Focusing Characteristics of Symmetrically Configured Bootlace Lenses" by Shelton, IEEE, 1978.

"A Microstrip Multiple Beam Forming Lens" by Fong.

DISTRIBUTED BIFOCAL ABBE-SINE FOR WIDE-ANGLE MULTI-BEAM AND SCANNING ANTENNA SYSTEM

This application is a continuation-in-part (CIP) of U.S. Ser. No. 09/004,759, filed Jan. 8, 1998, and a continuation-in-part of U.S. Ser. No. 09/110,687, filed Jul. 7, 1998, the disclosures of which are hereby incorporated herein by reference.

This invention relates to a reflector based multiple beam antenna system.

BACKGROUND OF THE INVENTION

High gain antennas are widely useful for communication purposes such as radar, television receive-only (TVRO) earth station terminals, and other conventional sensing/transmitting uses. In general, high antenna gain is associated with high directivity, which in turn arises from a large radiating aperture.

U.S. Pat. No. 4,845,507 discloses a modular radio frequency array antenna system including an array antenna and a pair of steering electromagnetic lenses. The antenna system of the '507 patent utilizes a large array of antenna elements (of a single polarity) implemented as a plurality of subarrays driven with a plurality of lenses so as to maintain the overall size of the system small while increasing the overall gain of the system. Unfortunately, the array antenna system of the '507 patent cannot simultaneously receive both right-hand and left-handed circularly polarized signals (i.e. orthogonal signals), and furthermore cannot simultaneously receive signals from different satellites wherein the signals are right-handed circularly polarized, left-handed circularly polarized, linearly polarized, or any combination thereof.

U.S. Pat. No. 5,061,943 discloses a planar array antenna assembly for reception of linear signals. Unfortunately, the array of the '943 patent, while being able to receive signals in the fixed satellite service (FSS) and the broadcast satellite service (BSS) at 10.75 to 11.7 GHz and 12.5 to 12.75 GHz, respectively, cannot receive signals (without significant power loss and loss of polarization isolation) in the direct broadcast (DBS) band, as the DBS band is circular (as opposed to linear) in polarization.

U.S. Pat. No. 4,680,591 discloses an array antenna including an array of helices adapted to receive signals of a single circular polarization (i.e. either right-handed or left-handed). Unfortunately, because satellites transmit in both right and left-handed circular polarizations to facilitate isolation between channels and provide efficient bandwidth utilization, the array antenna system of the '591 patent is blind to one of the right-handed or left-handed polarizations because all elements of the array are wound in a uniform manner (i.e. the same direction).

It is apparent from the above that there exists a need in the art for a multiple beam array antenna system (e.g. of the TVRO or DBS type) which is small in size, cost effective, and able to increase gain without significantly increasing cost. There also exists a need for such a multiple beam antenna system having the ability to receive each of the circularly polarized signals right-handed circularly polarized signals, left-handed circularly polarized signals, and/or the linearly polarized signals, horizontally polarized signals, vertically polarized signals, and also optionally any combination or variation of linearly and/or circularly polarized signals. Additionally, the need exists for such an antenna system having the potential to simultaneously receive signals from different satellites, the different signals received being of the circularly polarized type or of the linearly polarized typed, or combinations thereof.

It is a purpose of this invention to fulfill the above-described needs in the art, as well as other needs apparent to the skilled artisan from the following detailed description of this invention.

SUMMARY OF THE INVENTION

A multiple beam antenna system for simultaneously receiving signals of different polarity that are orthogonal to one another, the system comprising:

means for receiving each of first and second polarized signals that are orthogonal to one another;

means for simultaneously receiving said first and second signals;

at least two feedhorns, one per beam, for illuminating a shaped bifocal Abbe-sine reflector means; and said shaped bifocal Abbe-sine reflector means for establishing at least two approximately perfect foci in a plane, said at least two foci being approximately symmetric about an axis of an aperture of said reflector means in order to obtain an increase in off-axis performance of at least about plus/minus six to ten beam widths with side lobes lower than about −21 dB.

The two focus points slightly degrades on axis performance, but outside of the focal points improves performance. In certain embodiments, the two foci may be, for example, plus and minus 3 degrees from on-axis. Or optionally, they may be plus/minus 5 degrees relative to the on-axis.

Advantages of the multi focal point includes improved off axis performance. Thus, multiple beam systems are possible to receive from multiple sources simultaneously.

Generally speaking, this invention fulfills the above-described needs in the art by providing:

an orthogonal mode junction for use in a multibeam antenna system, the junction comprising:

a housing;

a feed area for simultaneously receiving first signals of a first polarity and second signals of a second polarity which is orthogonal to the first polarity;

isolating means within the housing for isolating the first signals from the second signals;

a first channel through which the first signals of the first polarity travel toward an end to a first waveguide;

a second channel through which the second signals of the second polarity travel toward and into a second waveguide; and wherein the isolating means causes the first signal of the first polarity to be forwarded into the first channel and the second signals of the second polarity to be forwarded into the second channel.

Those skilled in the art will appreciate the fact that array antennas and antennas herein are reciprocal transducers which exhibit similar properties in both transmission and reception modes. For example, the antenna patterns for both transmission and reception are identical and exhibit approximately the same gain. For convenience of explanation, descriptions are often made in terms of either transmission or reception of signals, with the other operation being understood. Thus, it is to be understood that the antenna systems of the different embodiments of this invention to be described below may pertain to either a transmission or reception mode of operation. Those skilled in the art will also appreciate the fact that the frequencies received/ transmitted may be varied up or down in accordance with the intended application of the system. Those of skill in the art will further realize that right and left-handed circular polarization may be achieved via properly summing horizontal and vertical linearly polarized elements; and that the antenna systems herein may alternatively be used to transmit/receive horizontal and vertical signals. It is also noted that the array antenna to be described below may simultaneously receive and transmit different signals.

This invention will now be described with respect to certain embodiments thereof, accompanied by certain illustrations, wherein:

IN THE DRAWINGS

FIGS. 25(*a*)–(*d*) are side cross sectional views of different lenses matching techniques which may be used in any embodiment of this invention.

Figure 23:
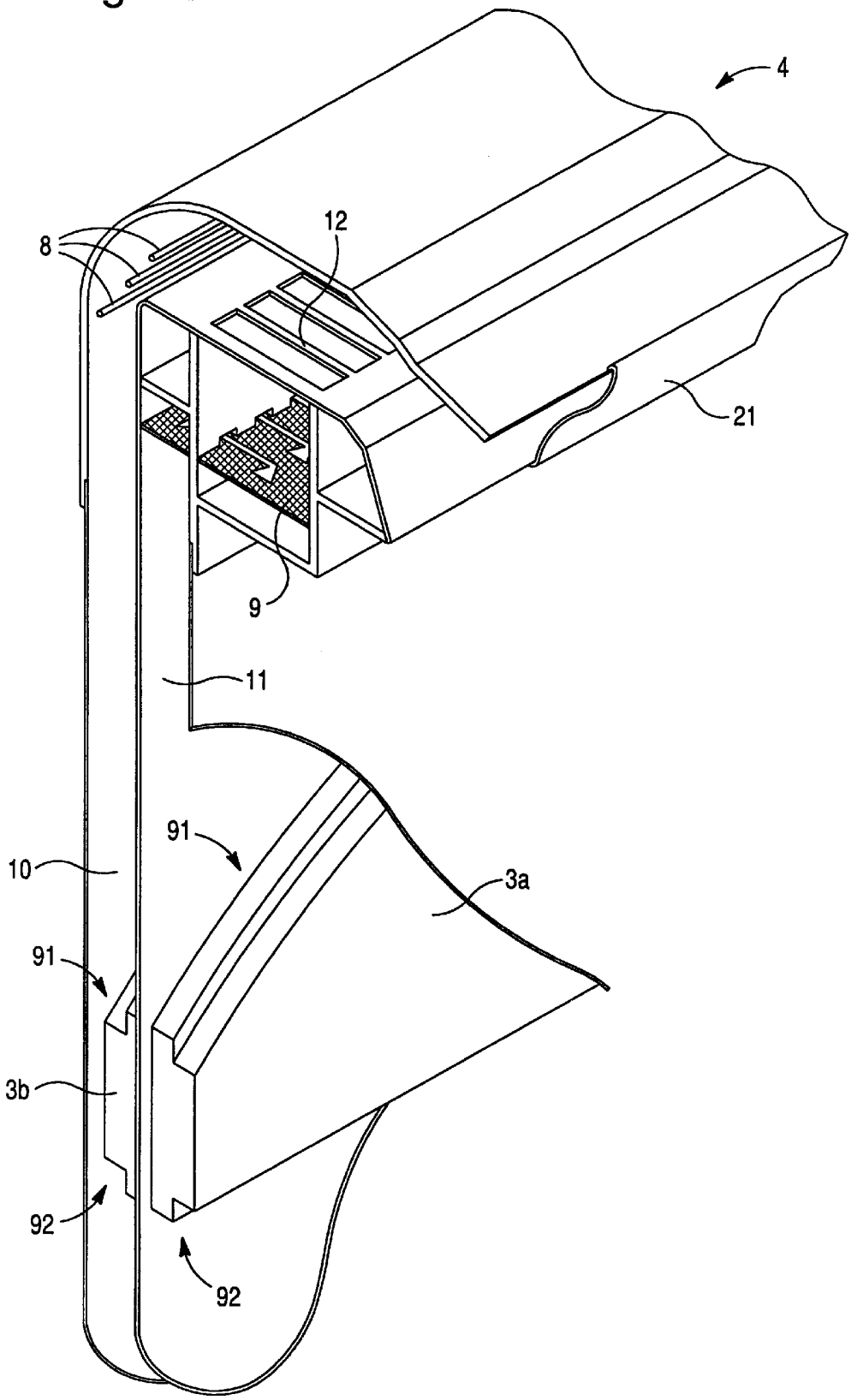
FIG. 23 is a partial cutaway perspective view illustrating the OMJ and the pair of corresponding waveguides and lenses according to an embodiment of this invention which may be used in conjunction with the reflector of the FIG. 1 embodiment.
Figure 24:
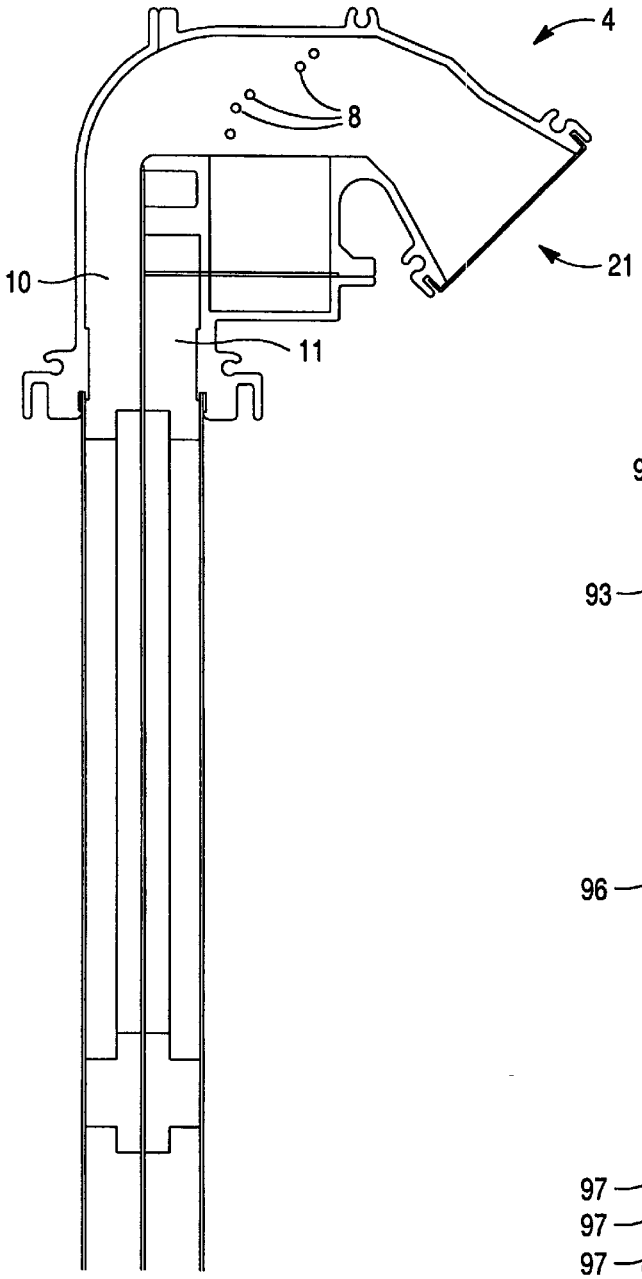
FIG. 24 is a side cross sectional view of the OMJ and waveguides of FIG. 23.
Figure 25A:
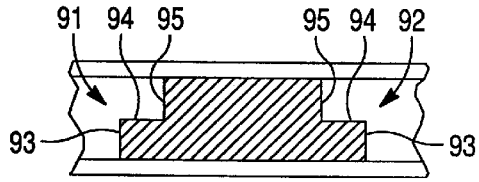
Figure 25B:
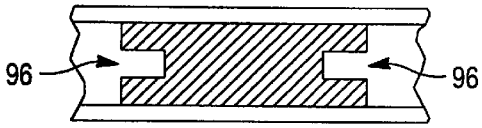
Figure 25C:
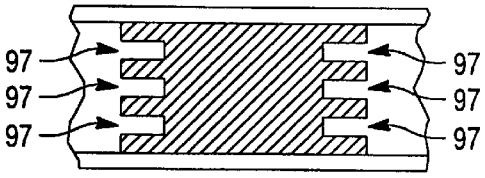
Figure 25D:
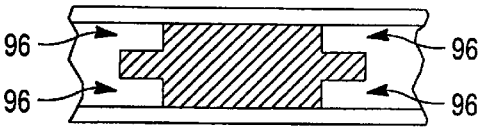
Figure 26:
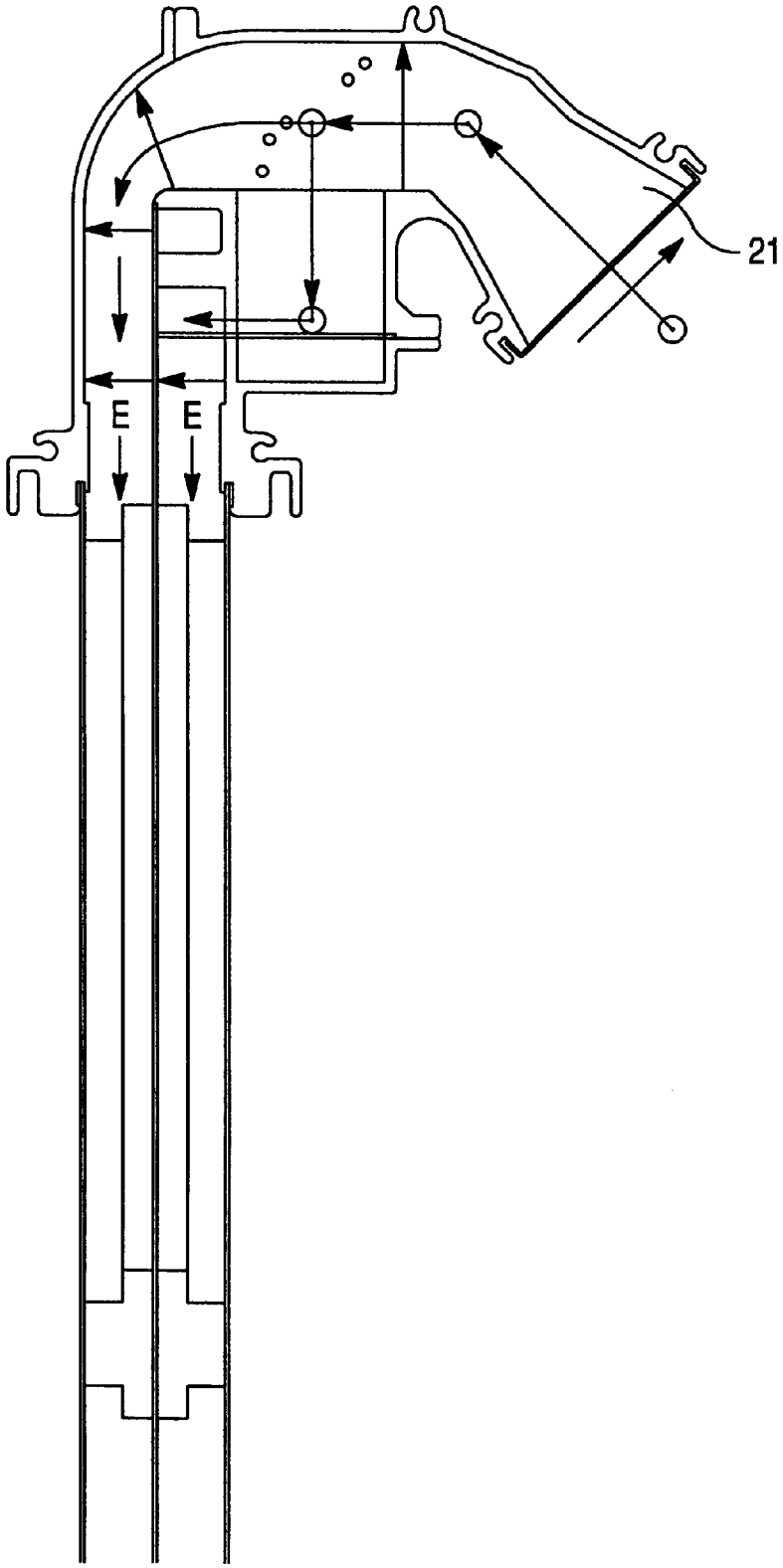

FIG. 26 is a combination side cross sectional view and schematic of the OMJ and waveguides of FIGS. 23–24.

Figure 27:
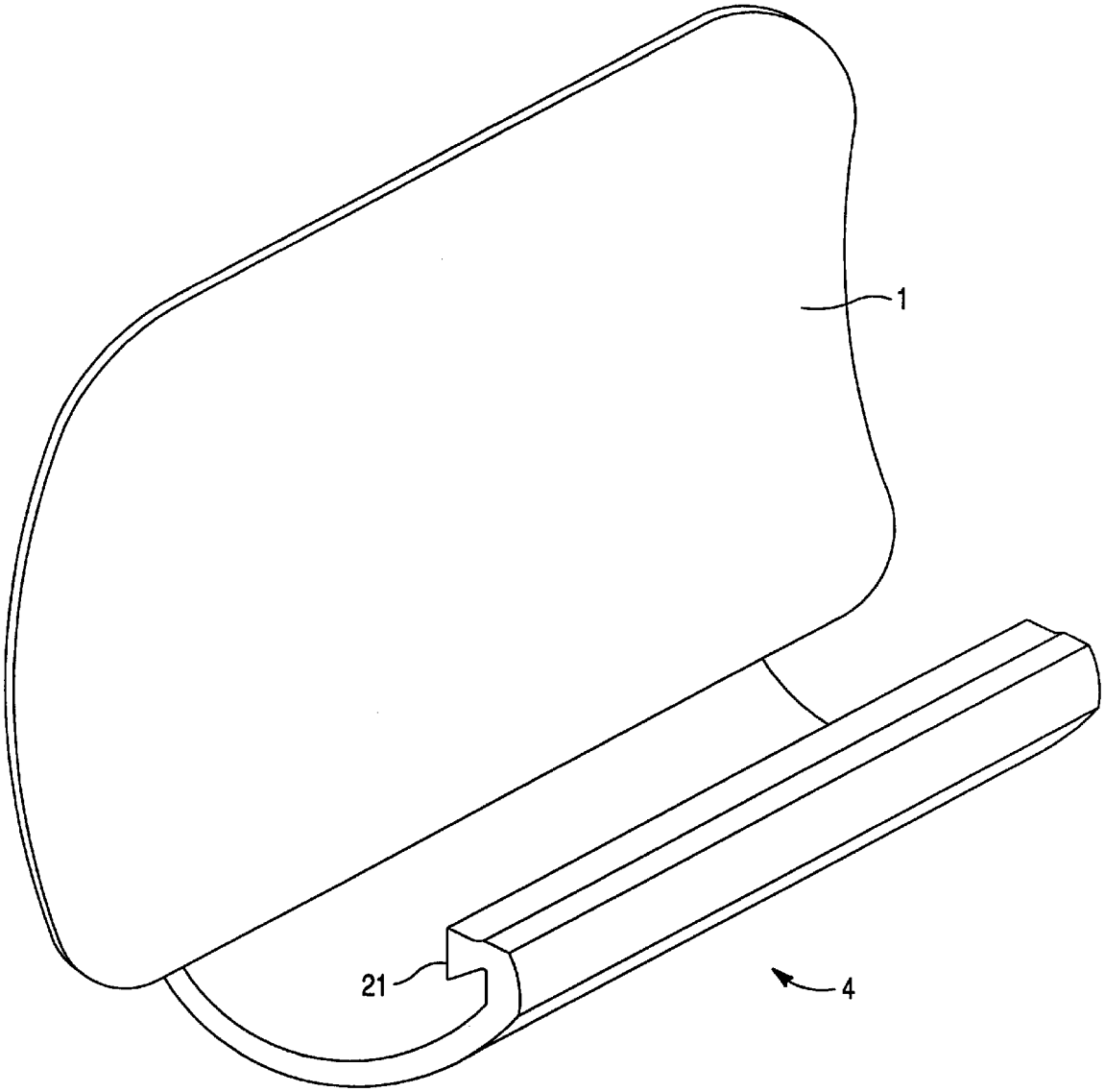

FIG. 27 is a perspective view of the reflector and OMJ which may be used in any embodiment of this invention.

Figure 28:
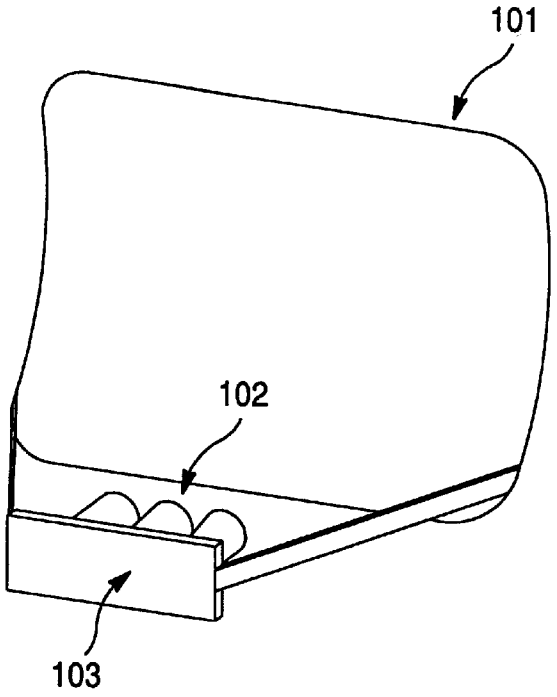
Figure 29:
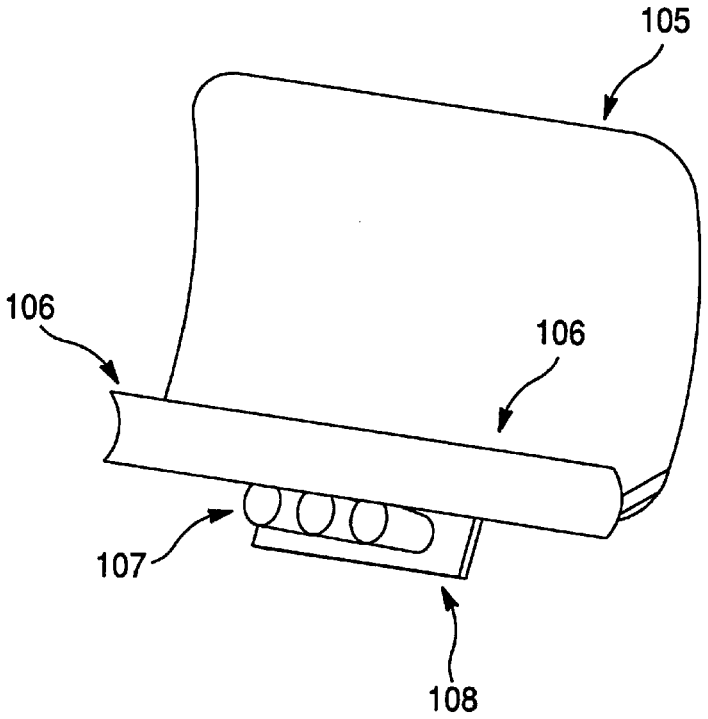
Figure 30A:
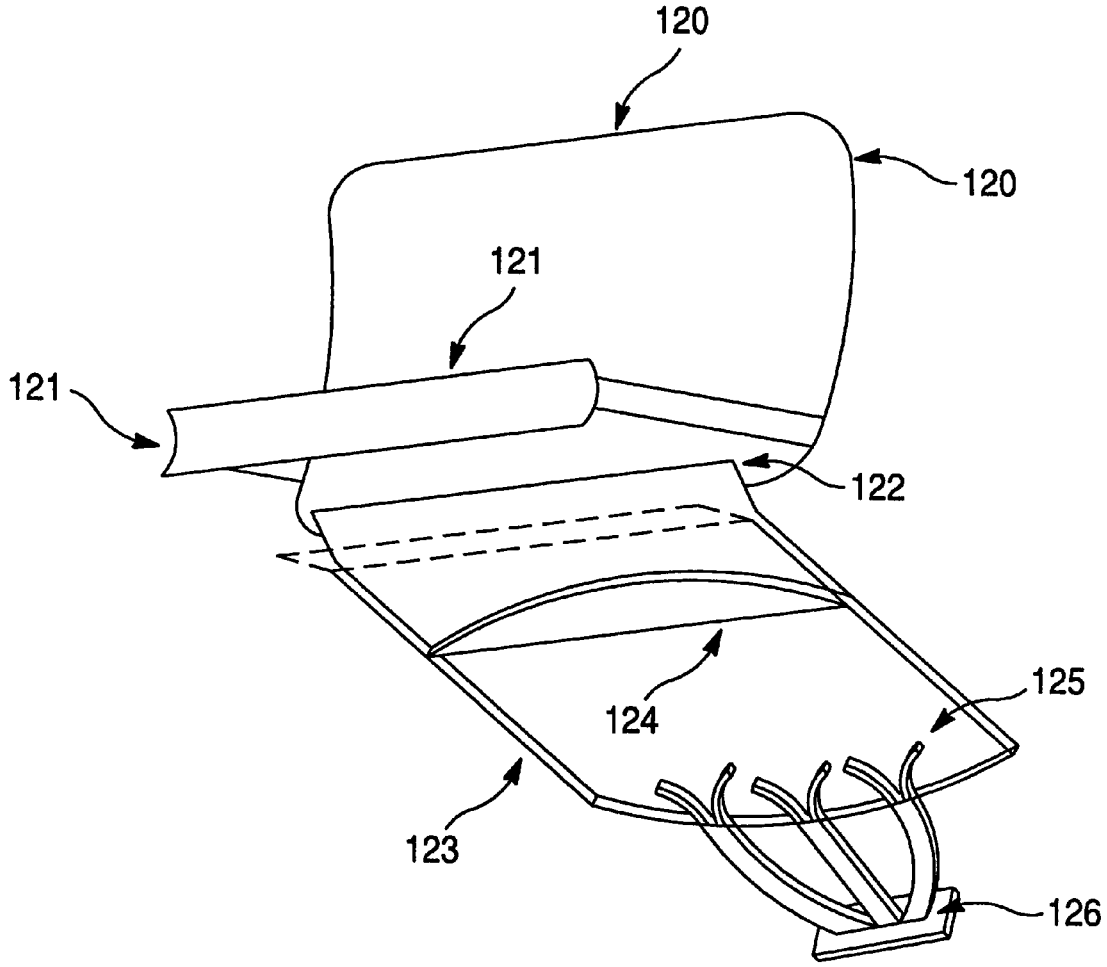
Figure 30B:
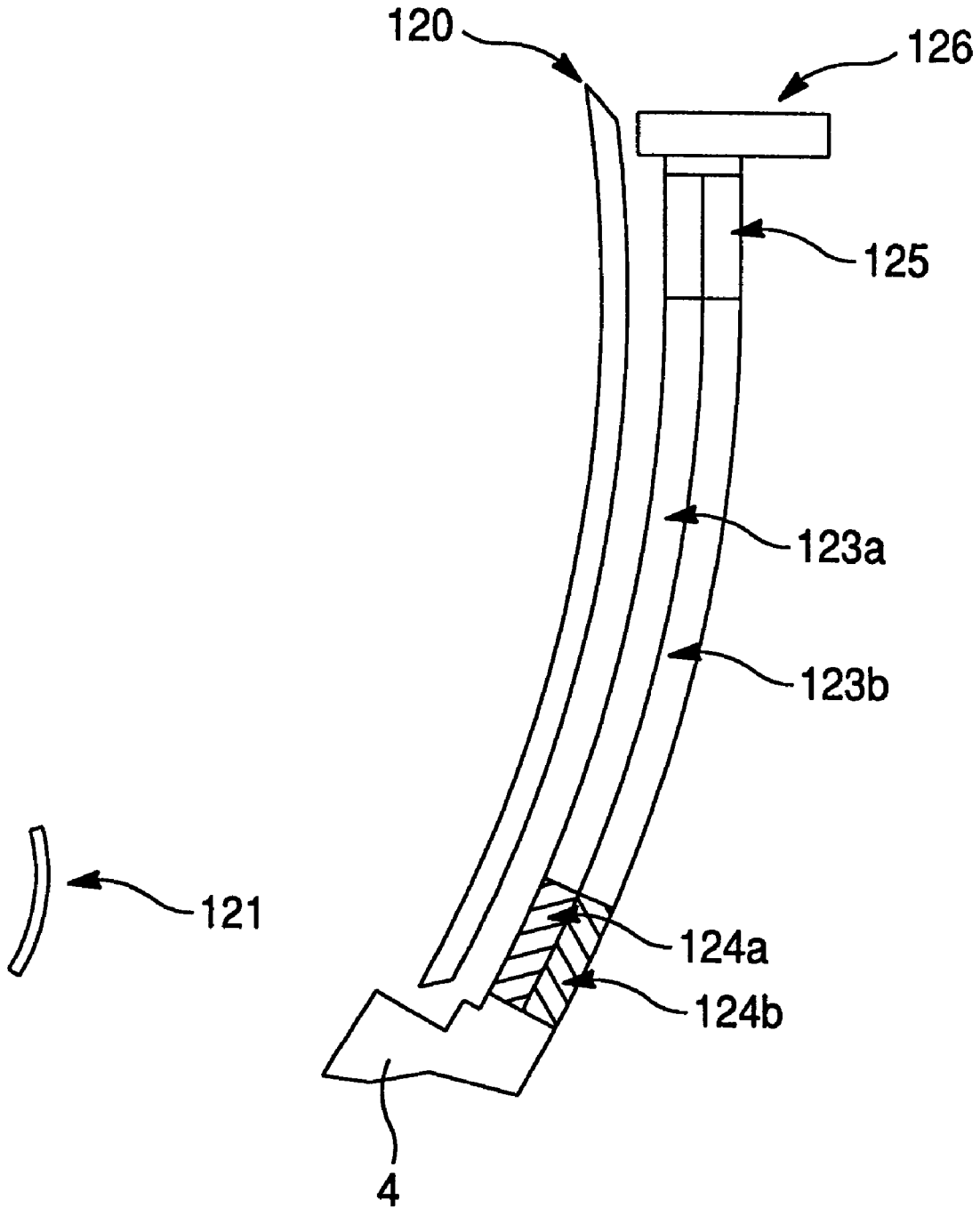

FIGS. 28–30 are perspective views of different embodiments wherein a shaped reflector(s) may be used to perform functionality performed by lens(es) in other embodiments of this invention.

Figure 31:
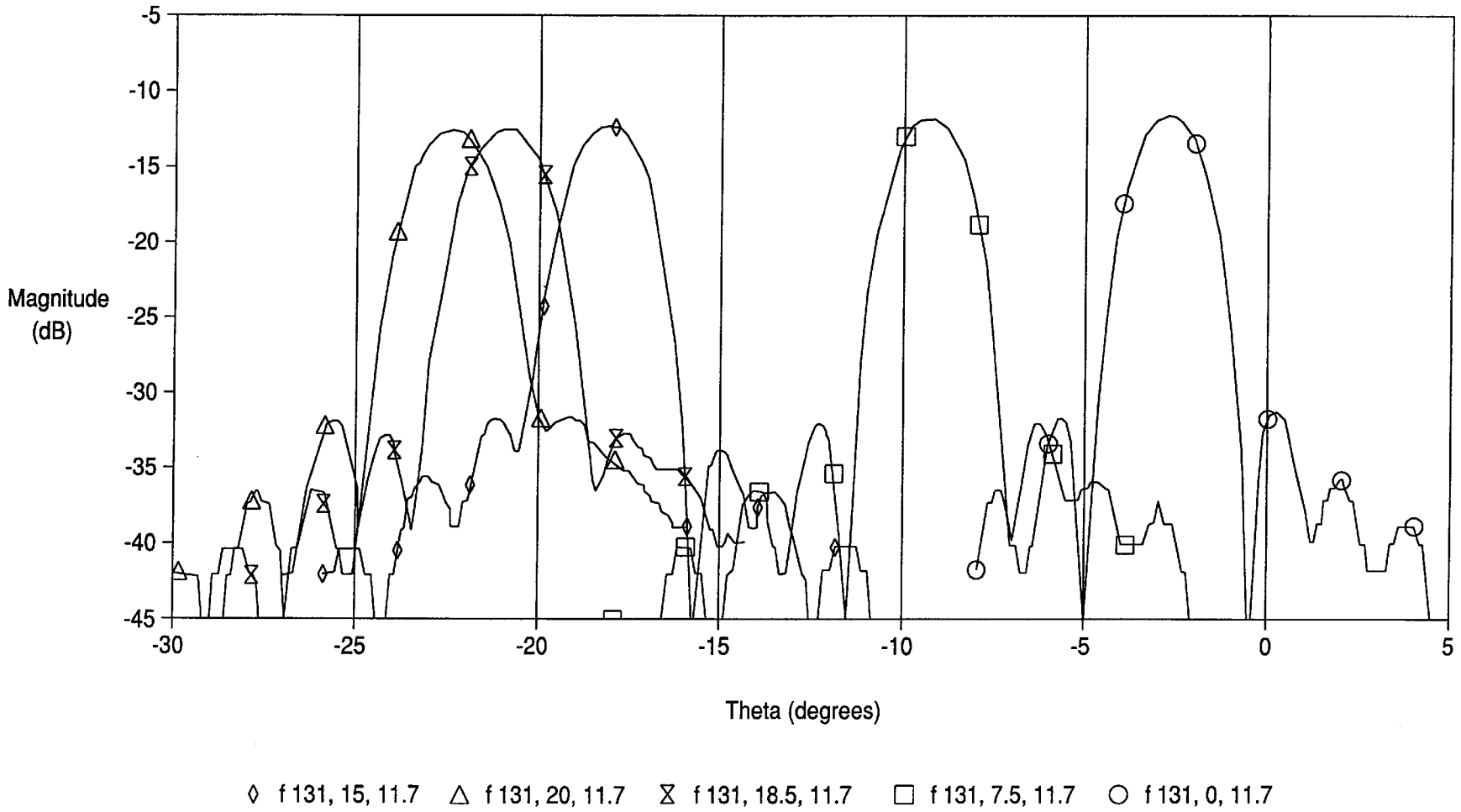
Figure 32:
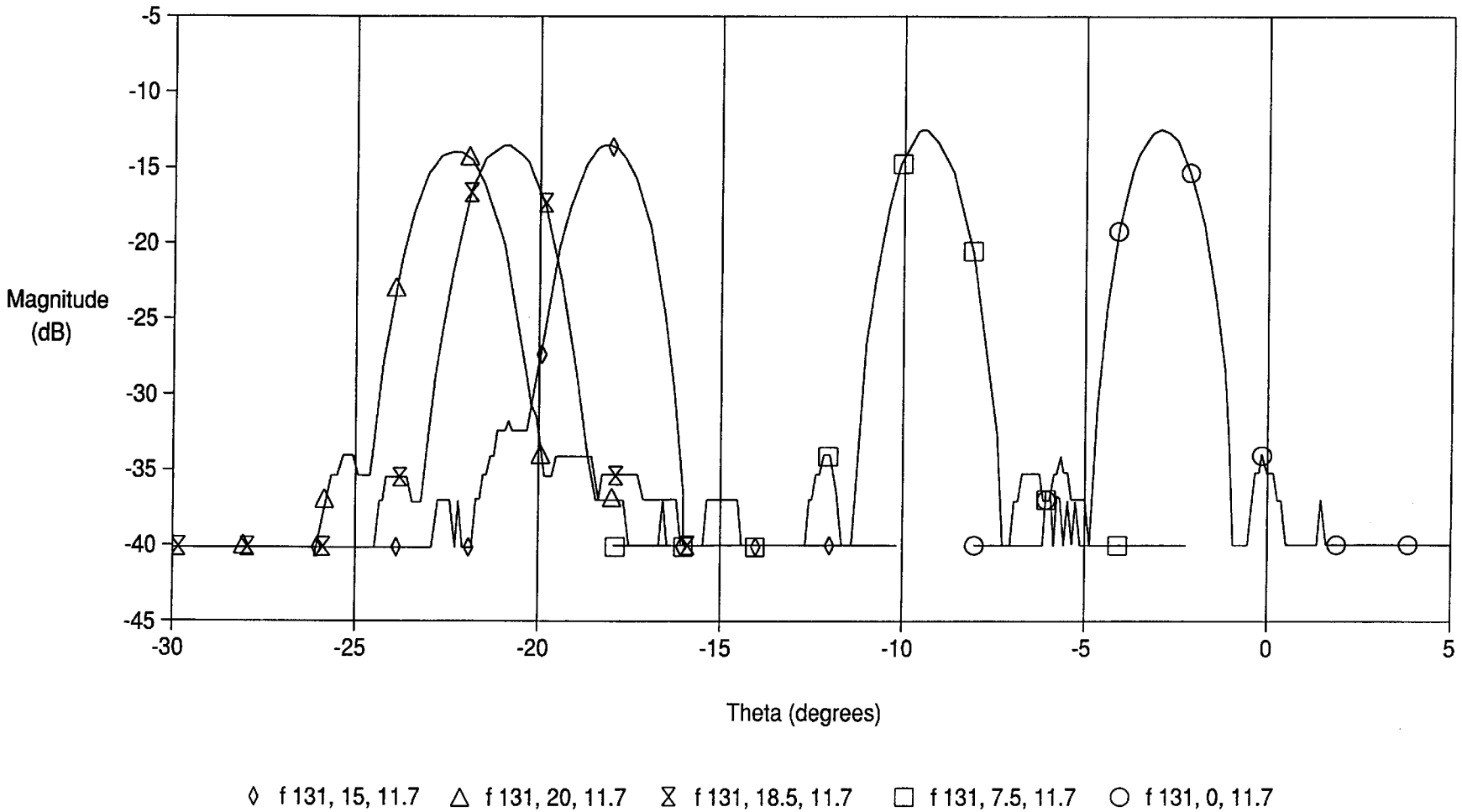

FIGS. 31–32 are graphs of data measured in accordance with FIGS. 28–30 embodiments of this invention.

DETAILED DESCRIPTION OF CERTAIN EMBODIMENTS OF THIS INVENTION

Referring now more particularly to the accompanying drawings in which like reference numerals indicate like parts throughout the several views.

Figure 1:
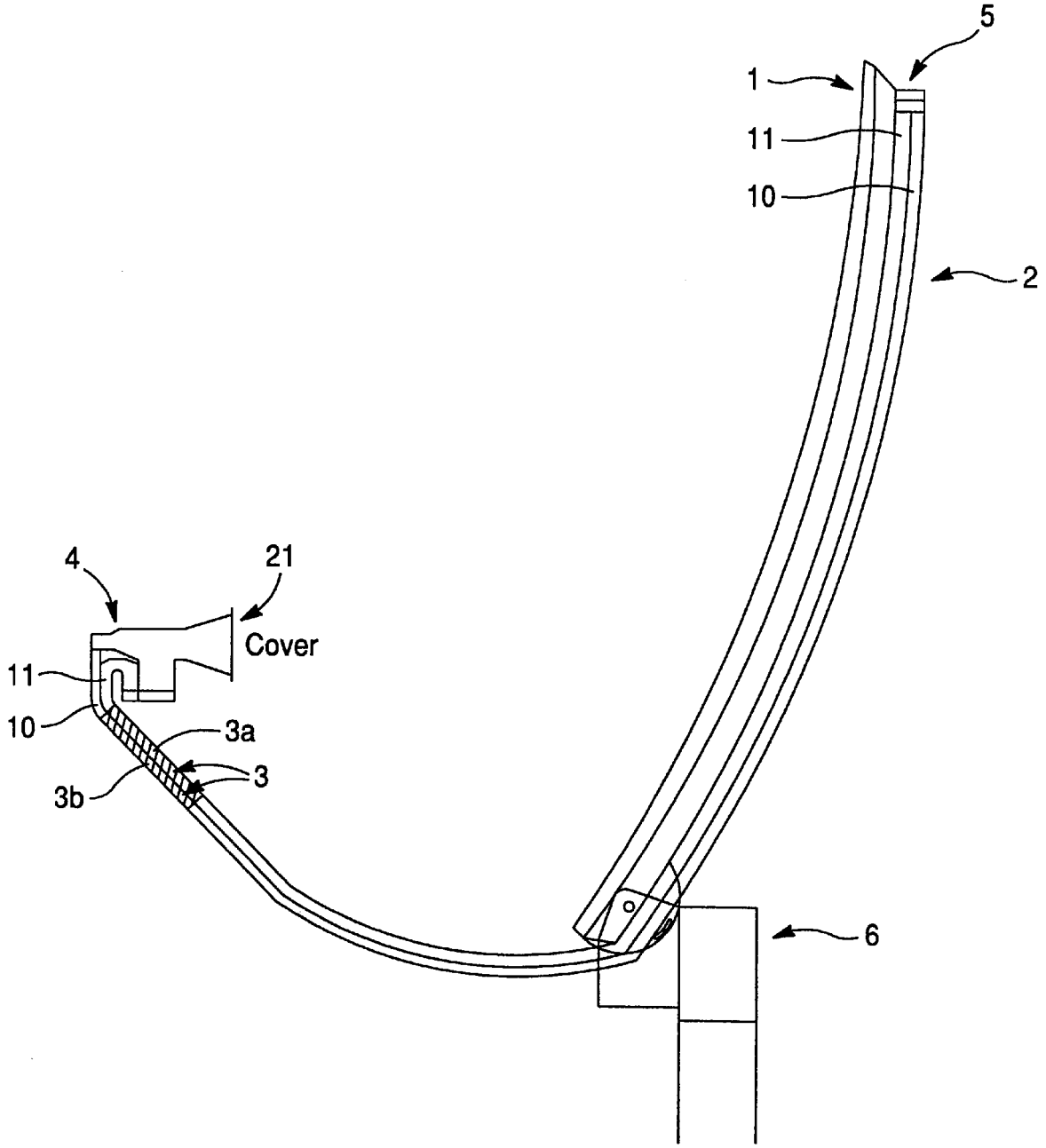
FIG. 1 is a side cross sectional view of a multiple beam antenna system according to an embodiment of this invention, the system including a reflector fed dual orthogonal dielectric lens coupled to a multiple beam port low noise block down converter (LNB).

FIG. 1 is a side cross sectional view of a multiple beam antenna system according to an embodiment of this invention, the system including a reflector fed dual orthogonal dielectric lens coupled to a multiple beam port low noise block down converter (LNB).

For example, in this invention, the antenna system can receive linear components of circularly polarized signals from satellites, break them down and process them as different linear signals, and recreate them to enable a viewer to utilize the received circularly polarized signals.

The system is adapted to receive signals in about the 10.70–12.75 GHz range in this and certain other embodiments. The multiple beam antenna system of this embodiment takes advantage of a unique dielectric lens design, including a pair of dielectric lenses 3*a* and 3*b* to produce a high gain scanning system with few or no phase controls. Electromagnetic lenses 3*a* and 3*b* (described below) are provided in combination with a switching network so as to allow the selection of a single beam or group of beams as required for specific applications. The antenna system receives (or transmits) signals from multiple satellites simultaneously, these different satellites coexisting. The multiples signals received from the multiple satellites, respectively, split up as a function of orthogonal componentry and follow different waveguides for processing. For example, vertically polarized signals may be divided out and travel down one waveguide while horizontally polarized signals are divided out and travel down another waveguide. In such a manner, a user may tap into different signals from different satellites, e.g. horizontally polarized signals, vertically polarized signals, or circularly polarized signals. Further, a plurality of different satellites may be accessed simultaneously enabling a user to utilize multiple signals at the same time.

A unique feature is the combination of at least partially cylindrical parabolic reflective member 1 with, or operatively associated with, dielectric lenses 3*a* and 3*b*. The combination or a beam forming network with a phase array illumination of a cylindrical parabolic dish allows the antenna system to simultaneously view many satellites (e.g. up to about seven but not limited to that number) of any polarity along their geostationary orbits. The dual lenses feed the reflective surface 1 of the dish, or vice versa. This design allows lenses 3*a*, 3*b* to simultaneously see or access more than one satellite signal, and allows the system to scale system or antenna gain and G/T to performance requirements of the user. The dish or reflector 1 provides efficient or cheap variable gain (i.e. scaling to accommodate various satellite E.R.I.P. and bandwidth requirements), while the lenses provide the beamforming phase capability. The overall system may weight from only about 12–15 pounds.

The multiple beam antenna systems of the different embodiments may be used in association with, for example, DBS and TVRO applications. In such cases, an antenna system of relatively high directivity is provided and designed for a limited field of view. The system when used in at least DBS applications provides sufficient G/T to adequately demodulate digital or analog television downlink signals from high and/or medium powered Ku band DBS and FSS satellites in geostationary orbit. Other frequency bands may also be transmitted/received. The field of view may be about 32 degrees in certain embodiments, but may be greater or less in certain other embodiments.

With respect to the term "G/T" mentioned above, this is the figure of merit of an earth station receiving system and is expressed in dB/K. $G/T=G_{dBi}-10\ \log T$, where G is the gain of the antenna at a specified frequency and T is the receiving system effective noise temperature in degrees Kelvin.

Figure 2:
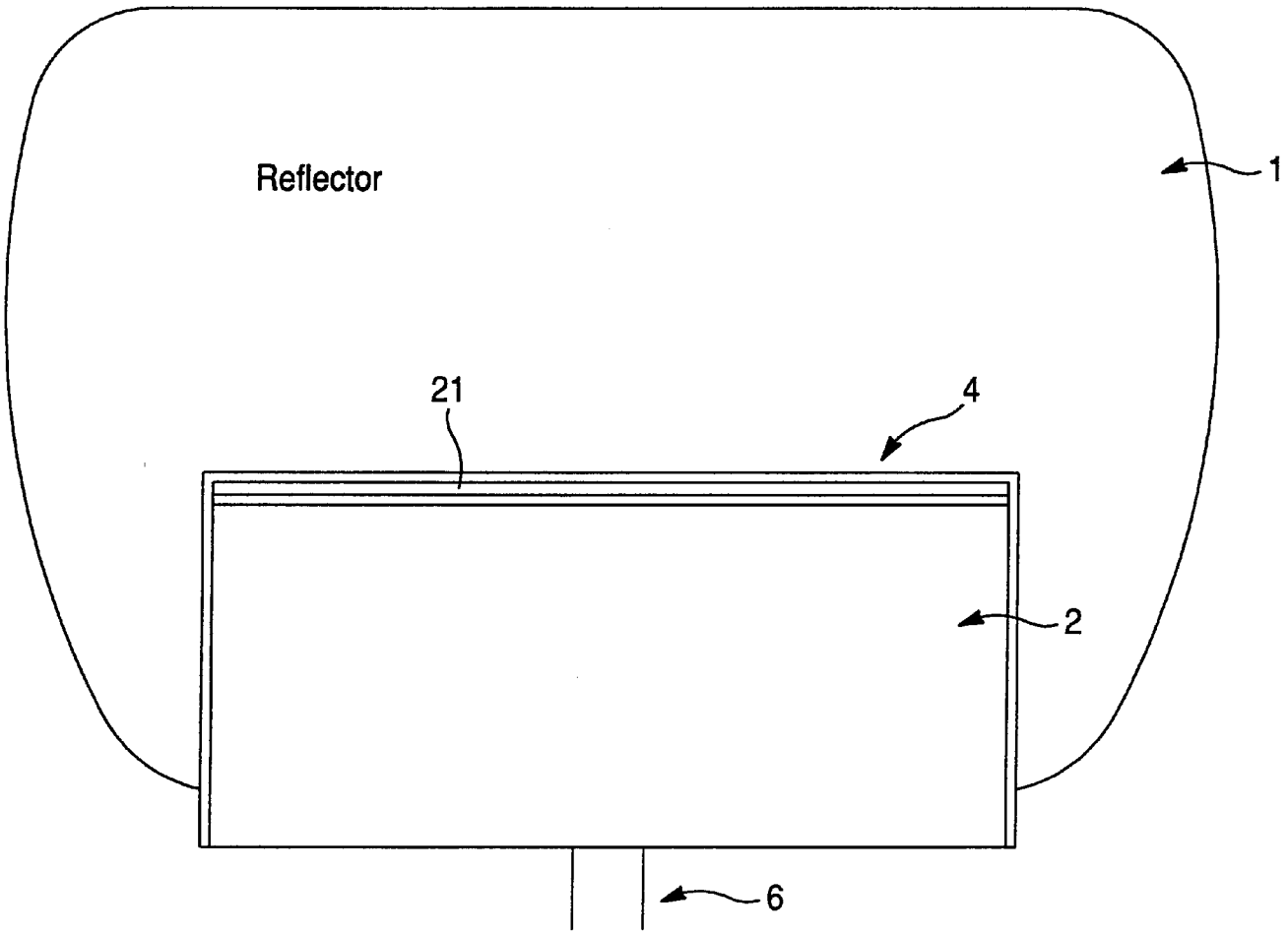
FIG. 2 is a front view of the FIG. 1 antenna system.
Figure 3:
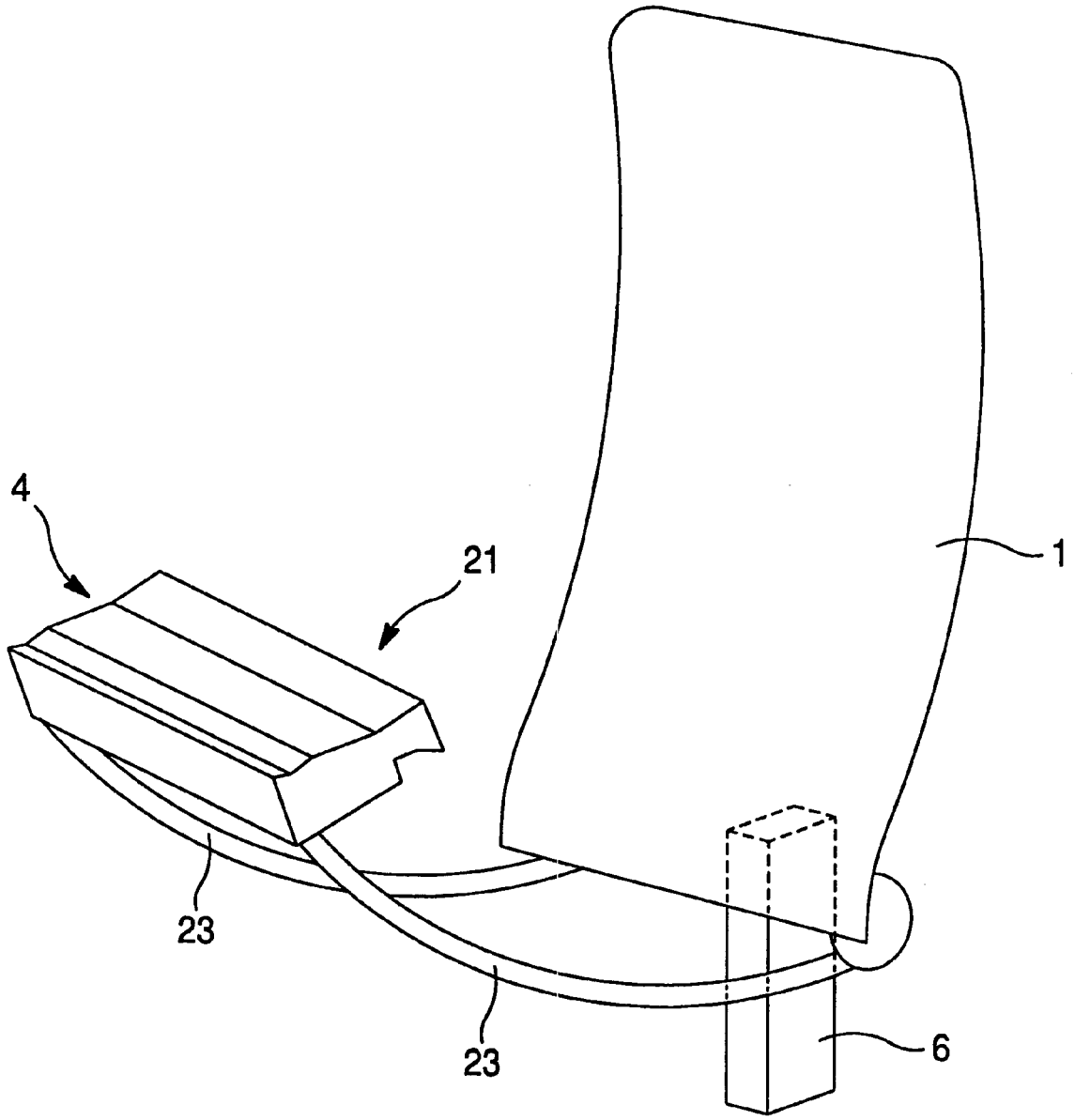
FIG. 3 is a perspective view of the FIGS. 1–2 antenna system.

Referring to FIGS. 1–3 and 28, the antenna system includes reflector member 1. Reflector 1 has a cylindrical parabolic or any other suitable shape, wherein in certain preferred embodiments the reflector has a parabolic shape in the vertical plane and a flat or planar shape in the z-axis. Thus, reflector 1 is not parabolic in both directions, but only one, in certain embodiments of this invention. Because reflector 1 is parabolic in the vertical plane as shown, the system has a long feed assembly along a focal line due to the non-parabolic design in the z-axis. This long or elongated feed assembly of the reflector 1 along the focal line allows orthogonal mode junction (OMJ) 4 to have an elongated, substantially horizontally aligned, feed area 21 as shown in FIGS. 2–3. In certain preferred embodiments, reflector 1 may be made of structural foam including a reflective metallic coating thereon. According to alternative embodiments of this invention, reflector 1 may be formed as a reflective surface of the waveguide 11.

The provision of reflector 1 in combination with dielectric lenses 3*a* and 3*b* allows the antenna system of certain embodiments of this invention to receive signals from satellites emitting either horizontally polarized signals or vertically polarized signals as will be discussed below. Horizontally and vertically polarized signals are orthogonal to one another as is known in the art. Furthermore, this invention in alternative embodiments may enable the user to receive signals from satellites emitting either left or right handed circularly polarized signals, or linearly polarized, as will be appreciated, as left and right handed circularly polarized signals are also orthogonal to one another.

The antenna system also includes first and second waveguides 10 and 11 which are collectively numbered 2. These two waveguides are aligned substantially parallel to one another, and each includes two parallel conductive surfaces spaced apart from one another (e.g. by about ⅜"). Waveguides 10 and 11 provide the radial TEM wave guide mode from corresponding lenses 3*a* and 3*b*, as they are both TEM mode radial guides. Each waveguide 10 and 11 includes two sections, one section located between OMJ 4 and the corresponding lens 3*a*, 3*b*, and another section disposed between the corresponding lens and LNB 5. Each waveguide may be made of any suitable material (e.g. stainless steel) and have, in certain embodiments, a conductive reflective aluminum or copper metal coating (i.e. low loss surface). Waveguides 11 and 10 allow microwaves from lenses 3*a* and 3*b* to focus on different output portions of LNB 5 corresponding to selectable different satellite locations. Two waveguides are needed because one is used to carry or convey each of the two orthogonal polarities, i.e. guide 10 carries one polarity and guide 11 the other polarity.

Dielectric lenses 3*a*, 3*b* are identical to one another in certain embodiments of this invention. Lenses 3*a* and 3*b* are fed orthogonally, as one lens 3*a* facilitates one polarity (e.g. horizontal) while the other lens 3*b* facilitates an orthogonal polarity (e.g. vertical). In certain embodiments, each lens 3*a*, 3*b* may be made of crystalline polystyrene or alternatively of polyethylene.

Mount 6 supports parallel waveguides 10, 11, as well as lenses 3*a*, 3*b*, reflector 1, and junction 4. Antenna mount assembly enables elevational adjustment, azimuthal adjustment, and rotational adjustment of the reflector 1 and feed 21 about the Clark belt.

Unique orthogonal mode junction 4, having feed area 21, receives linear signals from reflector 1, and separates the horizontally polarized signals from the vertically polarized signals, and places or directs them in corresponding separate parallel plate TEM waveguides 10 and 11 in order to illuminate dielectric lenses 3*a* and 3*b*. In other words, satellite signals, from a plurality of different satellites, are received by reflector 1 and are reflected into feed 21 of orthogonal mode junction (OMJ) 4 in the form of microwave signals. Junction 4 divides out vertically polarized microwave signals from horizontally polarized microwave signals, and forwards one polarity signal into waveguide 10 and the other polarity signal into waveguide 11. Thus, one lens 3*a* is illuminated by the vertical polarization sense and the other lens 3*b* is illuminated by the horizontal polarization sense. An important feature of OMJ 4 is that the feedhorn has the ability to accommodate the focal line of cylindrical parabolic reflector 1 and is also able to feed first and second parallel plate TEM-mode waveguides 10, 11, and first and second dielectric lenses 3*a* and 3*b*. The parallel plate orthogonal mode junction 4 in conjunction with lenses 3*a*, 3*b* and the parabolic reflector provide the advantages discussed herein.

From lenses 3*a* and 3*b*, the microwave signals propagate or travel down their respective waveguides 10 and 11 to multiple beam port low noise block converter (LNB) 5. LNB 5 includes printed circuit boards (PCBs) [shown in FIGS. 16–18] positioned within a housing. LNB 5 is responsible from selecting the specific satellite(s) of interest to the user and configuring the polarities of linear (horizontal and vertical) and circular (right and left hand of choice).

In certain embodiments of this invention, OMJ 4 may be made of extruded aluminum, or any other suitable material. Also, impedance matching steps 27 are provided withing the interior of OMJ 4 for impedance matching purposes (i.e. waveguide transformers).

FIG. 2 is a front view of the FIG. 1 antenna system. As shown in FIG. 2, feed 21 of OMJ 4 is elongated in design so as to correspond to a focal line of the reflector which is substantially parallel thereto. FIG. 3 is a perspective view of the FIGS. 1–2 system. Also illustrated in FIG. 3 are endcaps 23 located along the elongated and curved edges of the waveguides.

Figure 4:
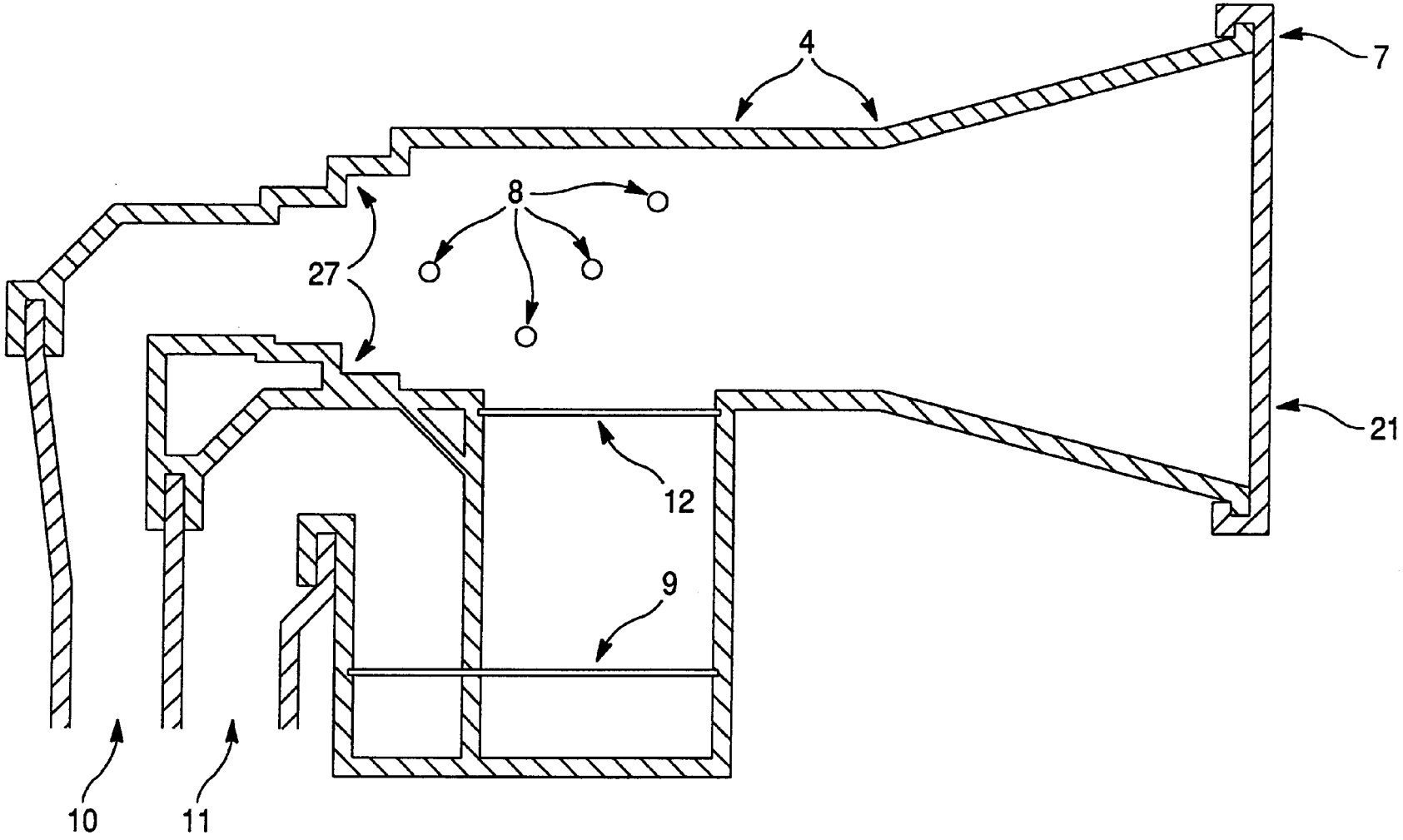
FIG. 4 is an enlarged side cross sectional view of the orthogonal mode junction (OMJ) member of the FIGS. 1–3 embodiment.
Figure 7:
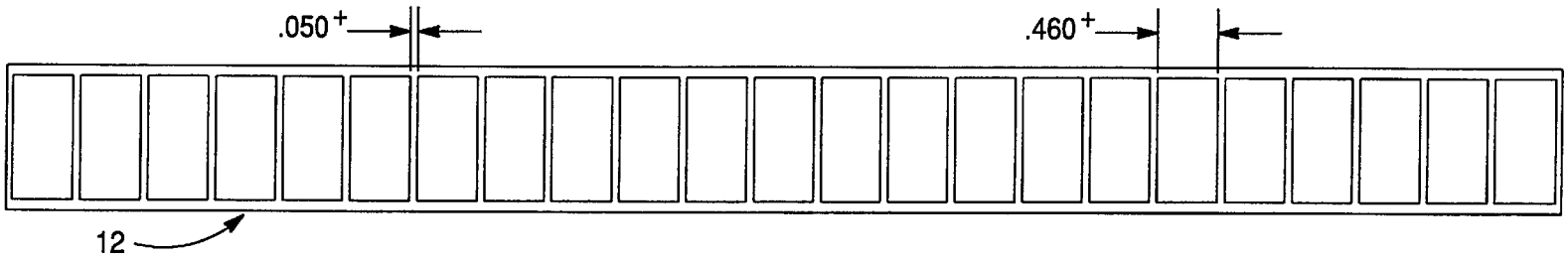
FIG. 7 is a top view of the isolating member of the FIGS. 4–6 orthogonal mode junction member, this member performing orthogonality selection in the junction.

FIG. 4 is an enlarged side cross sectional view of the orthogonal mode junction (OMJ) member 4 of the FIGS. 1–3 embodiment. Elongated rods 8, provided in the OMJ, may be from about 0.040 to 0.060 inches in diameter (preferably in this embodiment about 0.050 inches in diameter). Isolating rods 8 are configured within the housing of OMJ 4 so as to isolate the horizontally polarized component of the received (or transmitted) signal that comes into feed 21 from waveguide 10 to waveguide 11. Meanwhile, isolating board 12 in OMJ 4 isolates the vertical component of the received (or transmitted) signal from waveguide 11 to waveguide 10. Isolator 12 in certain embodiments may be fabricated of 0.0050 (5 mil) inch thick beryllium copper (or plane copper) in order to perform its isolation function. FIG. 7 is a top view of isolator 12, illustrating the grid assembly responsible for sorting out the orthogonal signals with rods 8.

It is noted that rods 8 represent the isolating means according to one embodiment of this invention. However, it is noted that other isolating structure may instead be utilized. For example, any suitable structure may be provided within the illustrated housing of the OMJ for dividing out or isolating the signals of different polarity. Rectangular members, triangular members, annular members, or structure integrally formed with the OMJ housing could instead be used to isolate the signals of different polarity and cause them to proceed toward the different waveguides 10, 11.

Figure 8:
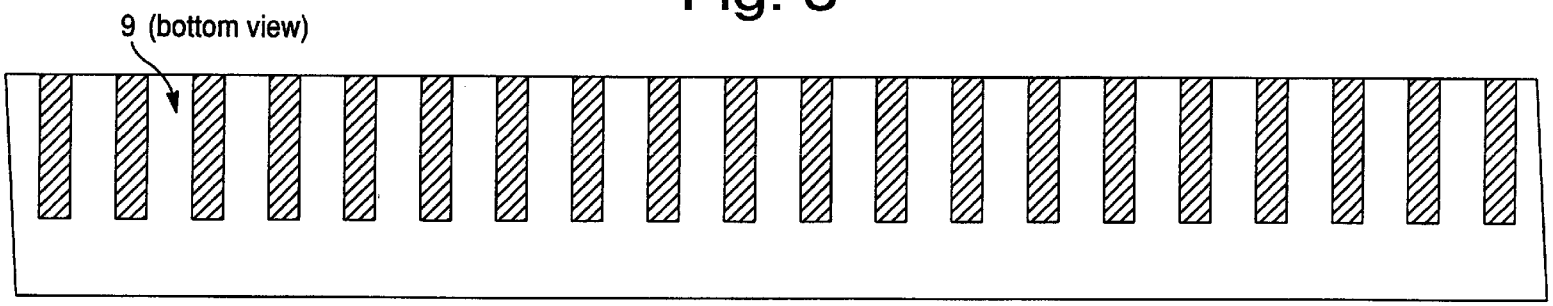
FIG. 8 is a bottom view of a printed circuit board (PCB) from the FIGS. 4–6 orthogonal mode junction member, this PCB transducing horizontal components of the received or transmitted signals into a TEM mode electromagnetic illumination of a parallel plate waveguide connected to the junction; and wherein the base board in FIG. 8 is shown in elevation form and the metal is shown in cross-section.
Figure 9:
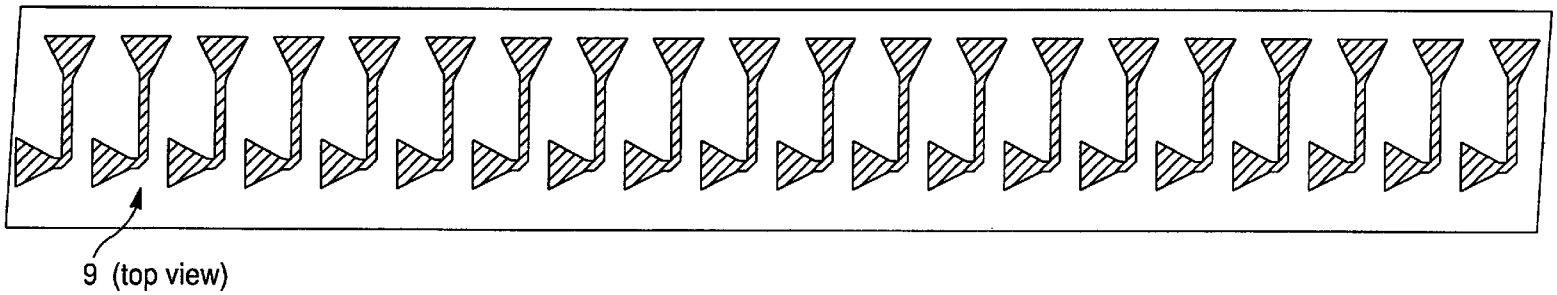
FIG. 9 is a top view of the FIG. 8 printed circuit board, with metal being shown in cross section and base board shown in an elevation manner.
Figure 11:
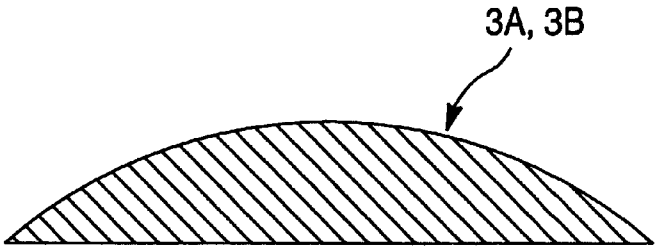
FIG. 11 is a cross sectional view of the FIG. 10 lens, along section line A—A.
Figure 13:
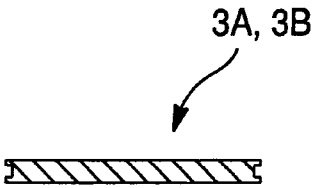
FIG. 13 is a cross sectional view of the FIGS. 10–12 lens, along section line B—B.

Transducer board 9, shown in FIG. 9 as part of OMJ 4, may be a printed circuit board (PCB) fabricated on 0.020 inch thick Teflon fiberglass in certain embodiments. Metal transducers on PCB 9 transduce the horizontal component of the received (or transmitted) signal into a TEM mode electromagnetic illumination of parallel plate waveguide 11. FIG. 8 is a bottom view of transducer board 9 while FIG. 9 is a top view of board 9, with the metallic transducers being shown in cross section.

OMJ 4 further includes radome 7 which has traditional radome characteristics such as protection, in order to accommodate the feed assembly.

Figure 5:
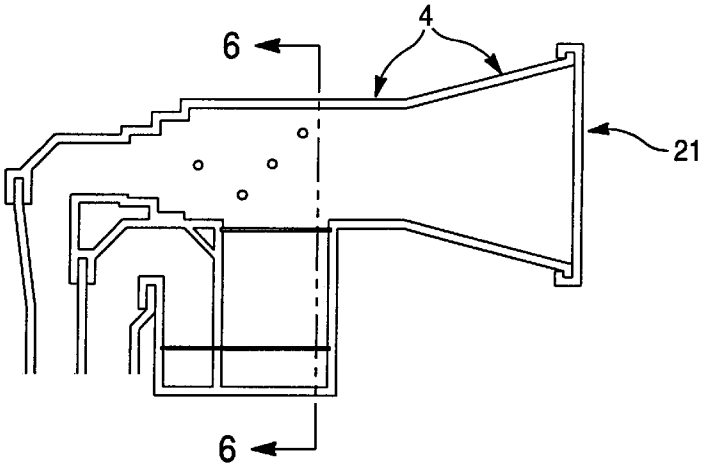
FIG. 5 is a side cross sectional view of the orthogonal mode junction of the FIGS. 1–4 embodiment.
Figure 6:
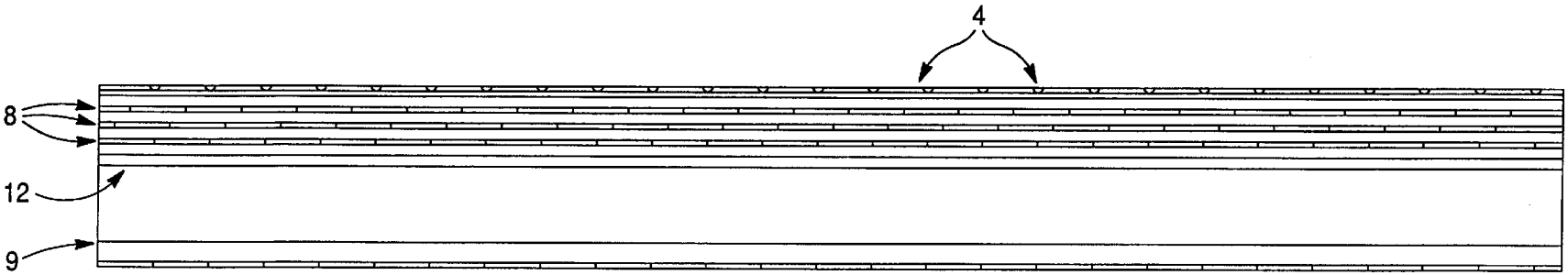
FIG. 6 is a cross sectional view of the FIGS. 4–5 orthogonal mode junction member taken along section line AA in FIG. 5.

FIGS. 5 and 6 further illustrate OMJ 4, with FIG. 6 being a sectional view along section line AA. As shown, each of components 8, 9, and 12 are substantially parallel to one another, and are substantially elongated in design. Each of elements 8, 9, and 12 is substantially as long as feed 21 of the OMJ.

Figure 10:
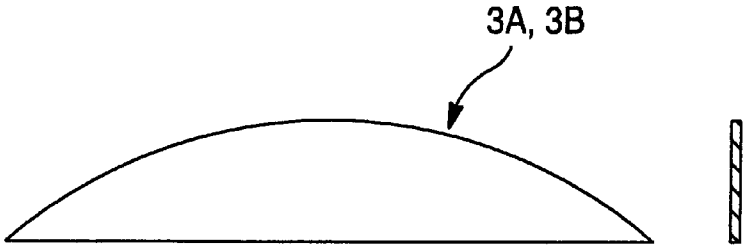
FIG. 10 is a schematic illustrating form and dimensions of a lens of the FIGS. 1–9 embodiment of this invention.
Figure 12:
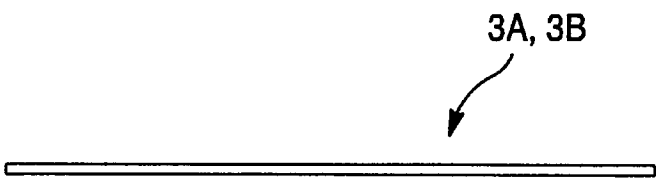
FIG. 12 is an elevational view of the FIGS. 10–11 lens.

FIGS. 10–3 illustrate one of dielectric lenses 3*a* or 3*b* according to an embodiment of this invention. In certain preferred embodiments, both optical lenses are identical, but may be different in other alternative embodiments. One lens is provided for each orthogonal mode, e.g. one for vertical signals and one for horizontal signals. The lenses according to this invention can receive/transmit linear or circularly polarized signals simultaneously.

Figure 14:
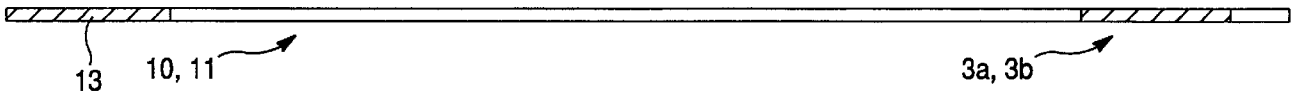
FIG. 14 is a side view of a waveguide of the FIG. 1 embodiment of this invention, the waveguide in this figure being shown in "flattened out" form for purposes of illustration (each of the waveguides are not "flat" but are instead curved as shown in FIG. 1, in operative embodiments of this invention).
Figure 15:
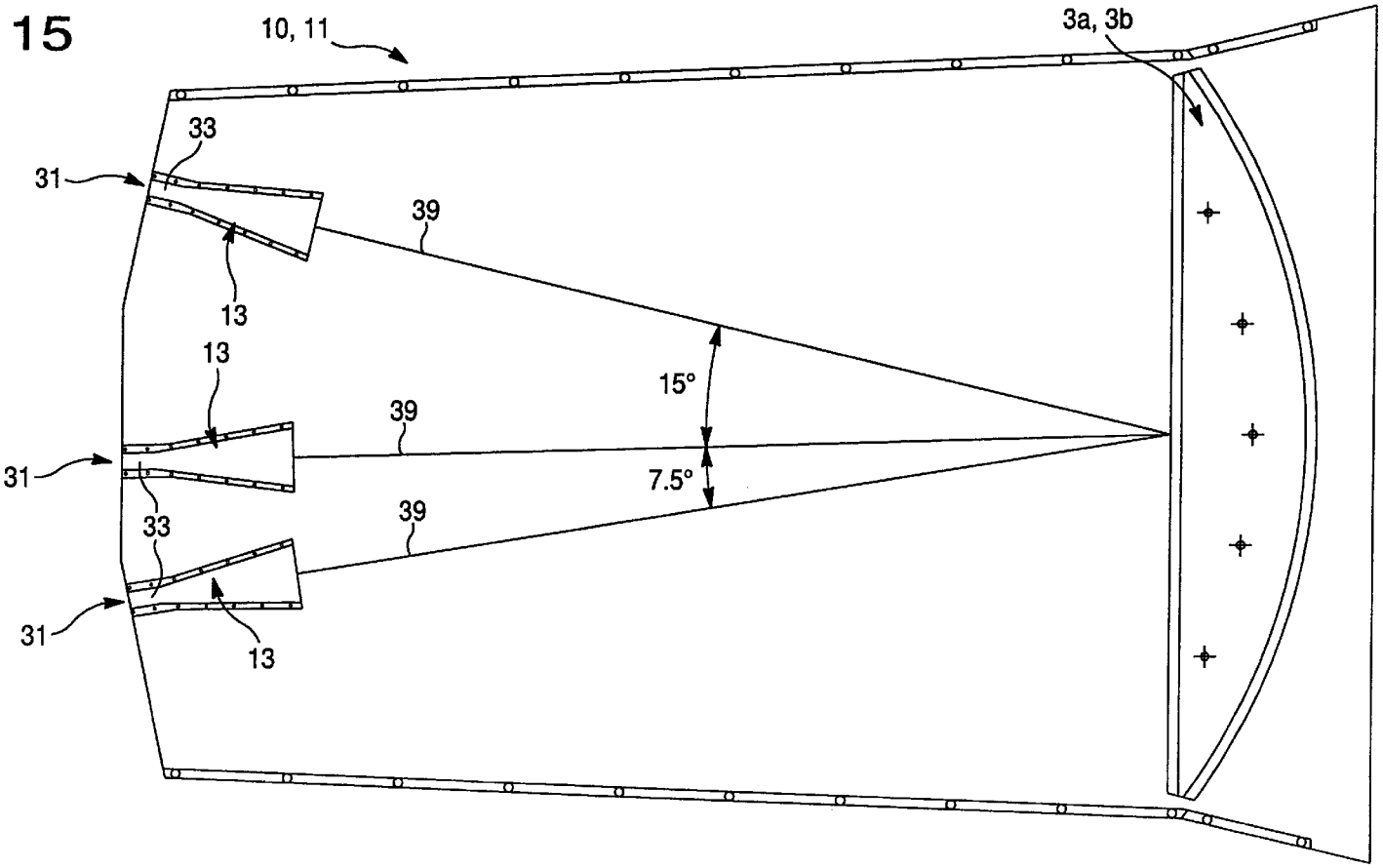
FIG. 15 is a top view of the FIG. 14 waveguide, including a lens therein.

FIGS. 14–15 illustrate sectoral feedhorns 13 within one of waveguides 10, 11. It is noted that while FIG. 14 illustrates the waveguide as being "flat" for purposes of simplicity, it really is not flat in practice [note the curved banana-shaped configuration of each waveguide 10, 11 in FIG. 1]. Feedhorns 13 are positioned within the waveguides so as to accommodate the orbital locations of the satellites of interest within the geostationary Clark belt. These focused horns 13 receive the focused signals from the corresponding dielectric lens 3*a*, 3*b* of the polarity of the corresponding lens. The configurations, quantity or number, and position of feedhorns 13 correspond to the number of satellites to be accessed or used. The outputs 31 of the feedhorns are coupled to the LNB circuit boards shown in FIGS. 16–18, through rectangular waveguides 33 of the WR-75 type.

Still referring to FIG. 15, from right to left, the microwave signals coming out of the lens 3*a*, 3*b* (when receiving satellite signals) propagate down the waveguide toward and into feedhorns 13. Lines 39 illustrate the scanning angle, provided by each feedhorn, of the different satellites (3 in this embodiment) to be accessed or used. As the positions of the feedhorns dictate which satellites are to be used, it is noted that there is a 15 degree difference in the location of the satellite corresponding to the uppermost feedhorn 33 and the middle feedhorn 33, while there is only a 7.5 degree difference in the position of the satellite corresponding to the middle feedhorn and the lowermost feedhorn 33. Thus, sectoral feedhorns 33 accommodate the satellites of interest. It is also noted that feedhorns 13 as shown in FIGS. 14–15 are sandwiched between a pair of upper and lower plates that of the corresponding waveguide, which are not shown.

Figure 16:
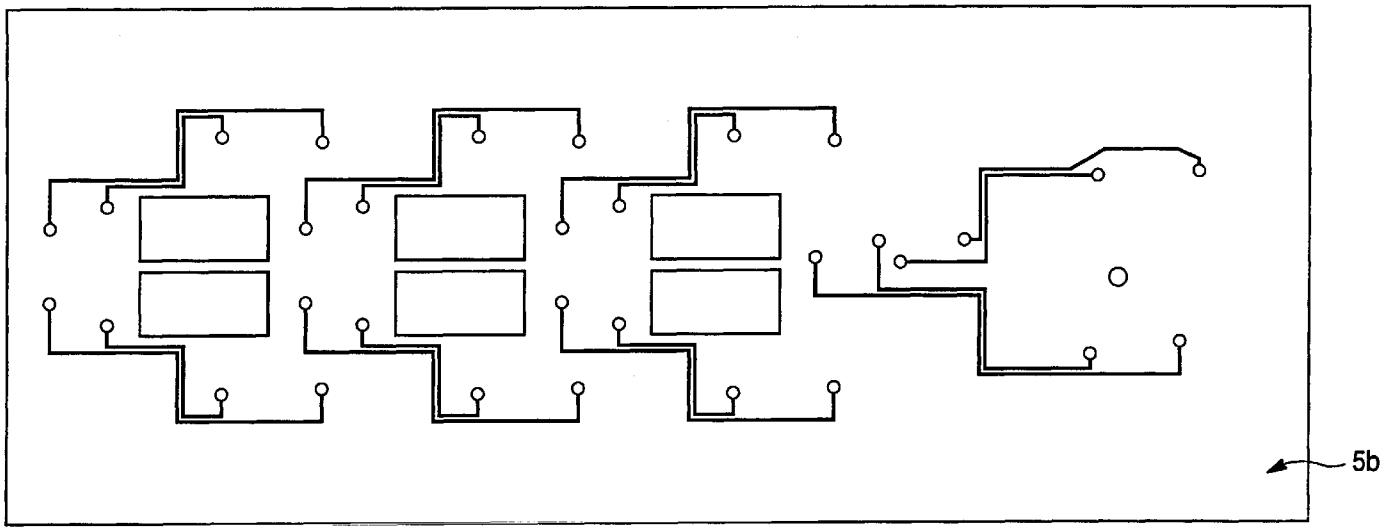
FIG. 16 is a bottom view of the RF PCB section of the three port low noise block converter (LNB) of the FIG. 1 embodiment of this invention.
Figure 17:
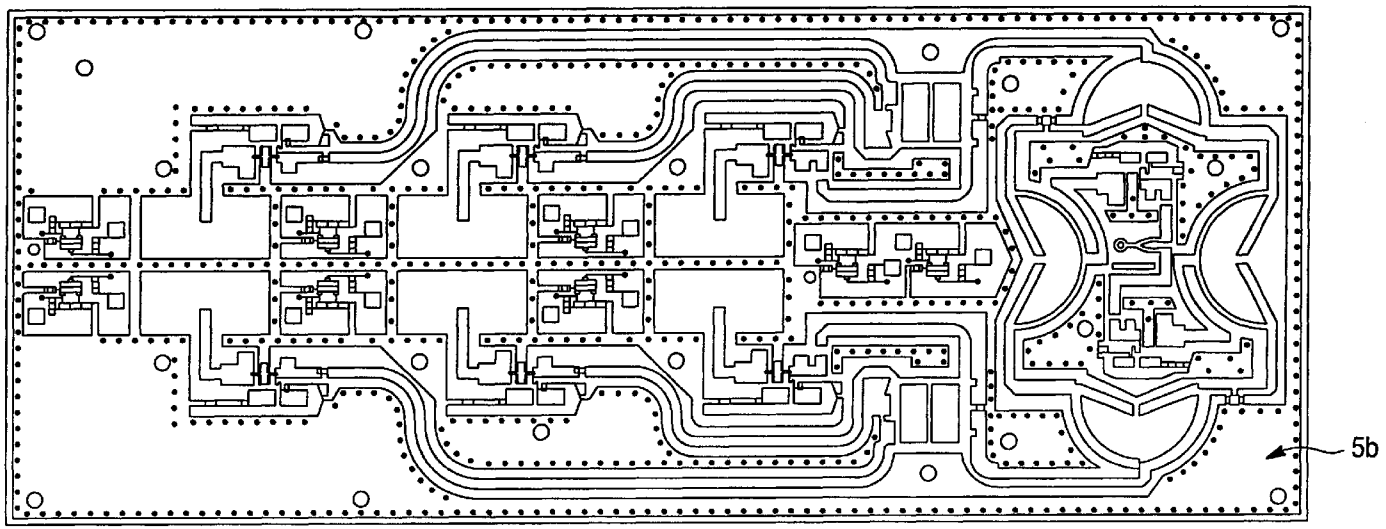
FIG. 17 is a top view of the RF PCB section of FIG. 16.
Figure 18:
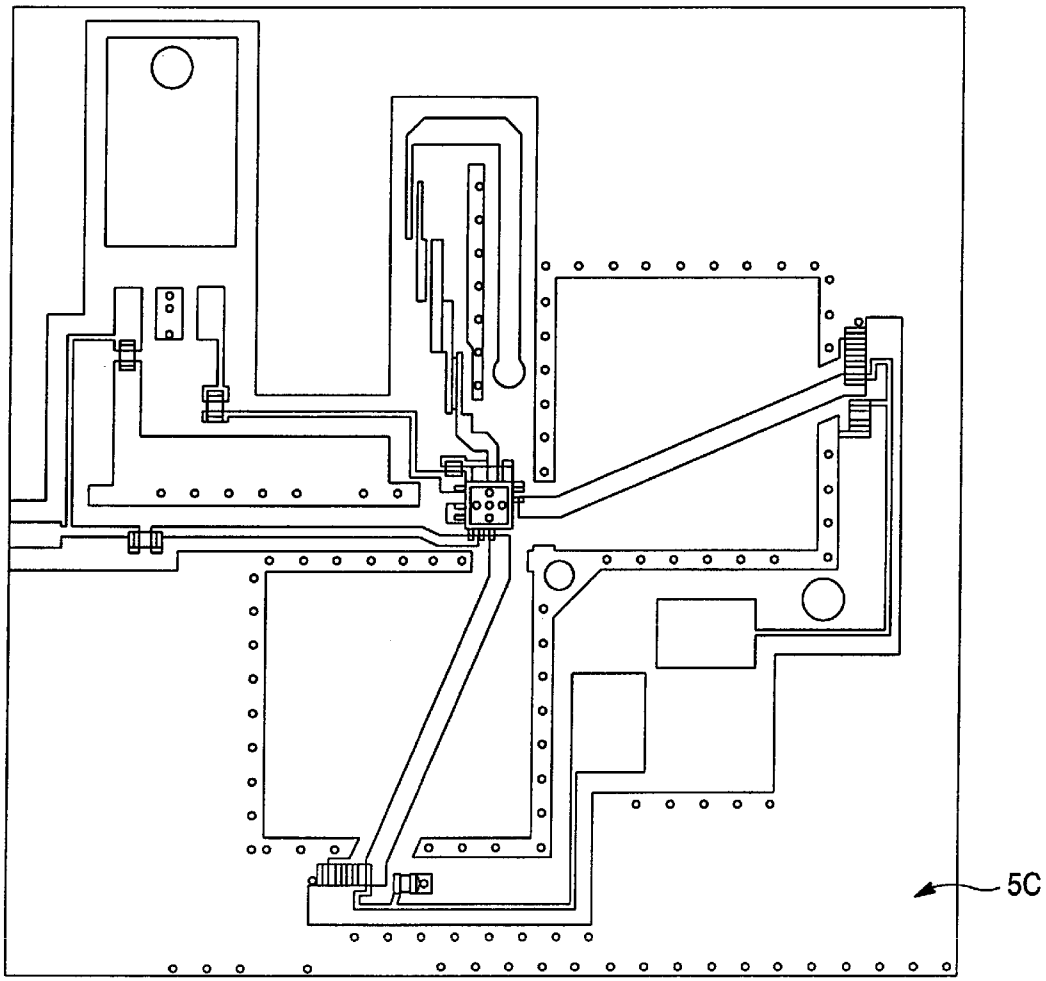
FIG. 18 is a top view of the local oscillator, filter, and down converter PCB within the housing of the LNB in the FIG. 1 embodiment.

The LNB 5 housing contains the two circuit boards shown in FIGS. 16–18. These boards perform the following functions: low noise RF amplification, down converts from RF to IF, selects IF frequency and number of IFs, selects satellites of interest as dictated by the user, selects polarity (linear (hor. or vert.) or circular [right-hand CP or left-hand CP]) of interest, switch matrix for multiple outputs or multiple IFs, IF amplification, converts WR-75 to circuit board strip-line waveguide, compensates for polarity skew in various geographic locations, and may be an antenna to set-top-box interface.

FIGS. 19–22 illustrate how lenses 3*a*, 3*b* may be utilized to access different types of signals according to certain embodiments of this invention. For a more detailed description, see U.S. Pat. No. 5,495,258, the disclosure of which is incorporated herein by reference.

While in preferred embodiments, each lense deals with a linearly polarized signal (either hor. or vert.), in certain embodiments, circularly polarized signals may also be accessed and utilized. In accordance with the above described lens designs, the lenses in combination of the multiple beam antenna systems of this invention allow the systems to select a single beam or a group of beams for reception (i.e. home satellite television viewing). Due to the design of the antenna array and matrix block (including the array of antenna elements of the inventions herein), right-handed circularly polarized satellite signals, left-handed circularly polarized satellite signals, and linearly polarized satellite signals within the scanned field of view may be accessed either individually or in groups. Thus, either a single or a plurality of such satellite signals may be simultaneously received and accessed (e.g. for viewing, etc.).

Figure 19:
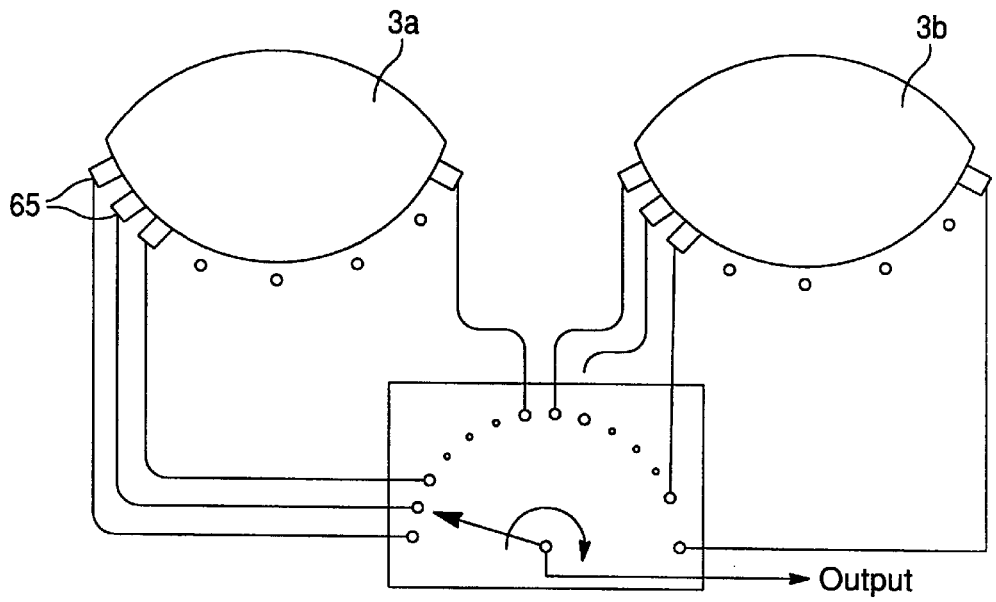
FIGS. 19–22 are schematic diagrams illustrating different scenarios of the lenses being manipulated by the output block in order to view particular satellites.

FIG. 19 illustrates the case where the user manipulates satellite selection matrix to simply pick up the signal from a particular satellite which is transmitting a horizontal signal. In such a case, the path in lens 3*a* is selected so as to tap into the signal of the desired satellite. A lens is a time delay device.

Figure 20:
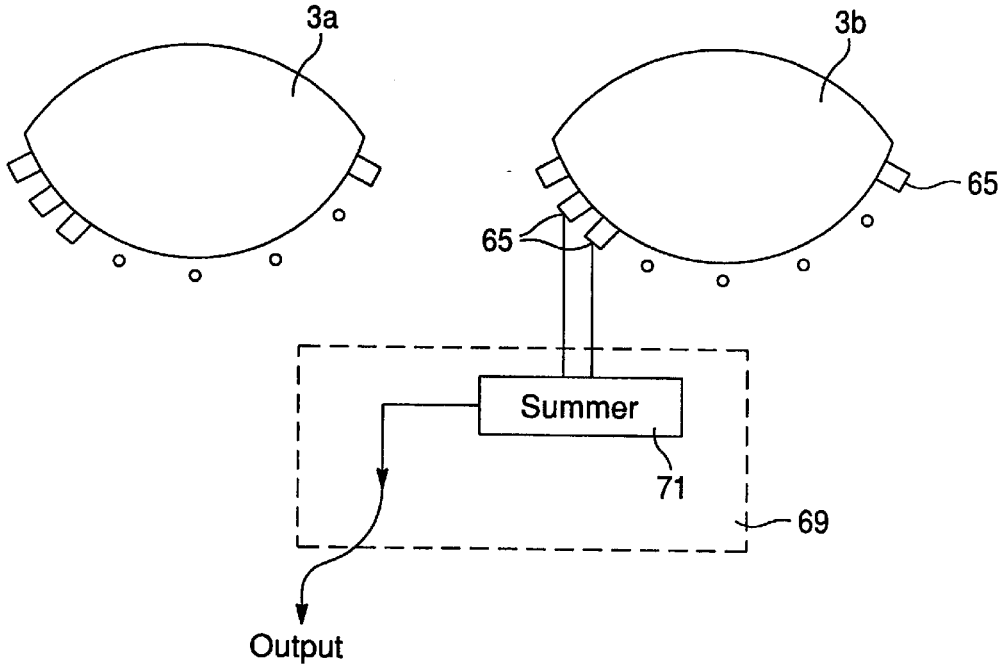

FIG. 20 illustrates the case where a plurality of received outputs from lens 3*b* are summed or combined in amplitude and phase. The signals from two adjacent outputs 65 are combined at summer 71 so as to split the beams from the adjacent output ports 65. Thus, if the viewer wishes to view a satellite disposed angularly between adjacent output ports 65, output block 69 takes the output from the adjacent ports 65 and sums them at summer 71 thereby "splitting" the beam and receiving the desired satellite signal. It is noted that a small loss of power may occur when signals from adjacent ports 65 are summed in this manner.

Figure 21:
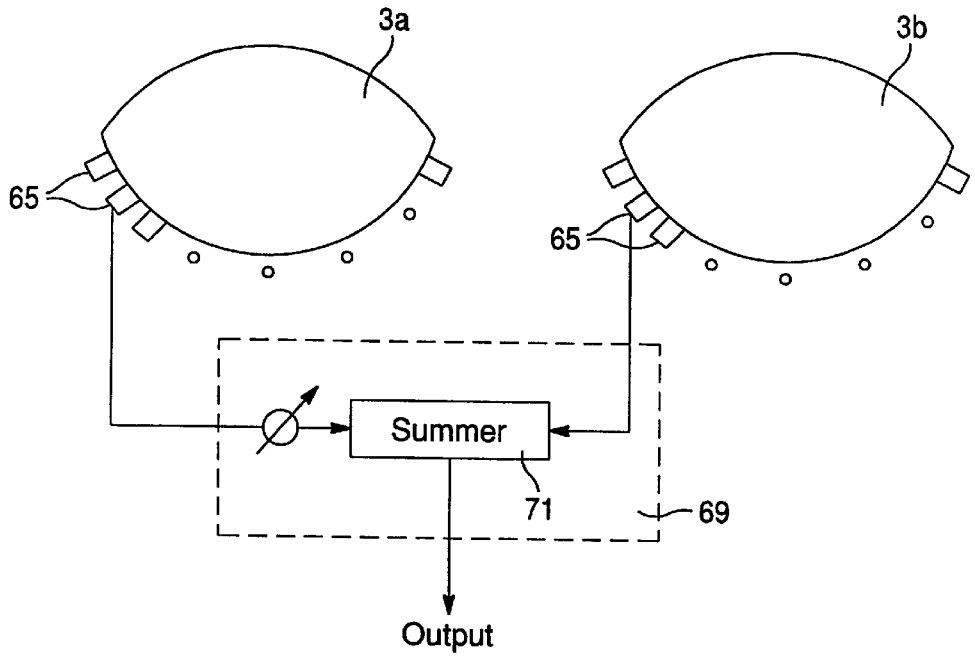

FIG. 21 illustrates the case where outputs 65 from both lenses are tapped (in a circular embodiment as described in the '258 patent) so as to result in the receiving of a signal from a satellite having circular (or linear) polarization.

Figure 22:
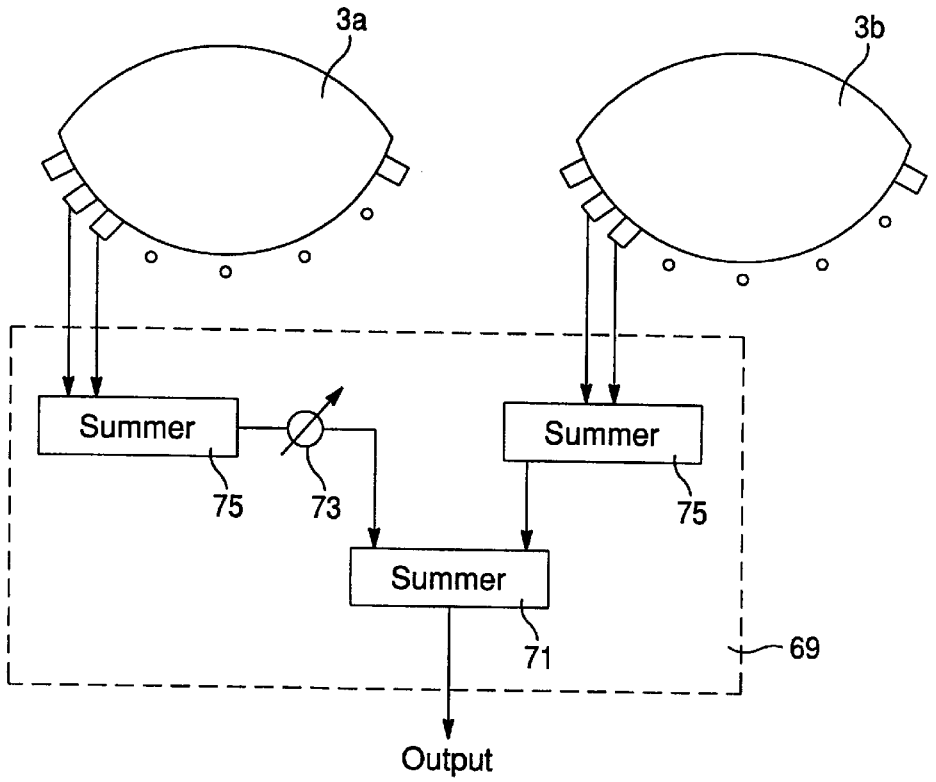

FIG. 22 illustrates the case where it is desired to access a satellite disposed between the beams of adjacent ports 65 wherein the satellite emits a signal having circular (or linear) polarization. Adjacent ports 65 are accessed in each of lenses and are summed accordingly at summers 75. Thereafter, phase shifter 73 adjusts the phase of the signal from one lens and the signals from the lenses are combined at summer 71 thereafter outputting a signal from output block 69 indicative of the received circularly polarized signal.

Once given the above disclosure, therefore, various other modifications, features or improvements will become apparent to the skilled artisan. Such other features, modifications, and improvements are thus considered a part of this invention, the scope of which is to be determined by the following claims. For example, the above-discussed multiple beam antenna system can receive singularly or simultaneously any polarity (circular or linear) from a single or multiple number of satellites, from a single or multiple number of beams, knowing that co-located satellites utilize frequency and/or polarization diversity.

In certain alternative embodiments of this invention, microwave dielectric lenses 3*a* and 3*b* for multibeam or scanning applications may have a bifocal design used in combination with Abbe Sine design methodology. This increases the scanning angle of the lens. FIGS. 23, 24, 25 (*a*) and 26 illustrate lenses 3*a* and 3*b* having a bifocal design with a "step" offset 91 on the edges of the lenses closest to OMJ 4 and another step offset 92 on the opposite edge of the lenses farthest from the OMJ. A collimating lens was designed to be coma free for a limited scan by imposing the known Abbe Sine condition. By constructing a plano-convex lens with a dielectric constant from about 2.4 to 2.7 (preferably about 2.55), a coma free beam over an angular coverage of plus/minus eight beam widths, with side lobe performance lower than about −18 dB, was achieved.

The addition of bifocal methodology for establishing two approximately perfect foci in the principal plane for two approximately symmetric off-axis beams was combined with the Abbe Sine condition methodology for the lenses 3*a* and 3*b* shown in FIGS. 23–26. This slightly diminished the performance of other beams which lie between the two foci by increasing the side lobes less than about 1 dB. Surprisingly, an increase in off-axis performance resulted to more than about plus/minus ten (10) beam widths with side lobes lower than −21 dB.

Further improvement in side lobe performance of dielectric lenses herein can be accomplished by matching it to the parallel plate TEM radial waveguide environment of the lens that will be used. A simplified matching technique is desired to accommodate low cost, high volume, manufacturing of antenna systems disclosed herein. In matching, the shape of surfaces of the lenses results in the canceling of surface reflections which may cause a decrease the gain of the antenna system due to increases in side lobe level and input standing-wave ratio. The two surfaces or edges of a lens which are exposed to the transverse E-plane wave are the surfaces that benefit from matching.

FIGS. 25(*a*)–(*d*) illustrate bifocal lenses 3*a*, 3*b* according to different embodiments of this invention, located within a parallel plane of the surrounding TEM waveguide. In the FIG. 25(*a*) embodiment (also shown in FIGS. 23, 24 and 26), the lens 3*a* (or 3*b* ) includes steps 91 and 92 on opposite edges thereof. These steps or slots are provided for matching purposes. Each step 91, 92 includes a first vertical portion 93 which is oriented approximately perpendicular to the adjacent waveguide surface, a second horizontal surface 94 which is approximately parallel to each of the opposing waveguide surfaces, and a third vertical portion 95 which is approximately perpendicular to portion 94 and to the adjacent waveguide surface. The planar portion of the lens whose outer periphery is defined by portions 93 has a larger volume and larger surface area adjacent the immediately adjacent waveguide surface than the planar portion of the lens whose periphery is defined by portions 95. Thus, the FIG. 25(*a*) lens includes two planar portions which are either integrally formed with one another, or which may be laminated to one another in some embodiments.

The FIG. 25(*b*) lens 3*a*, 3*b* may be used in other embodiments of this invention. This lens includes a slot 96 defined in the opposing edges of the lens for matching purposes. In addition to the square slot shown in FIG. 25(*b*), slots of other shapes may instead be used, such as rectangular, oval, and the like.

The FIG. 25(*c*) lens 3*a*, 3*b* may be used in other embodiments of this invention, and includes a plurality of approximately parallel slots defined in the opposing edges of the lens for matching purposes. For example, three slots 97 are shown in each of the opposing edges in FIG. 25(*c*), although from two through twenty slots may be provided in each edge in different embodiments of this invention. However, it is noted that the FIG. 25(*a*) lens has been found to be easier to manufacture, have lower tolerances, and a higher level of ruggedness and is thus preferred in certain embodiments of this invention for use in volume production.

FIG. 25(*d*) shows an embodiment utilizing a projection or tongue for the aforesaid purposes.

Referring now to OMJ 4 of FIGS. 23, 24, and 26, the OMJ of this embodiment is used in conjunction with the illustrated parallel plate TEM radial waveguides. The OMJ design enables the use of a single feedhorn which performs as a linear array, with element spacing infinitesimally small, that may be aligned to a focal line of the cylindrical parabola reflector 1. The long or elongated feed assembly of the reflector along the focal line allows OMJ 4 to have an elongated, approximately horizontally aligned, feed 21 as shown in FIGS. 2 and 27. OMJ 4 in turn delivers signals to the two parallel plate dielectric lenses 3*a*, 3*b* in a way that both are electrically orthogonal to one another. This is unlike the prior art, because in the prior art junctions for waveguides are single circular or rectangular (square) wave guides with a multiplicity of them used to feed a parallel plate guide. Thus, the instant OMJ is an improvement over traditional techniques which are more complicated and expensive to manufacture. Furthermore, conventional junctions would have to be configured as a multiplicity of elements and their spacing would cause grating lobes and the individual feed patterns would dictate scanning loss for off axis performance.

Referring still to FIGS. 23, 24, and 26, the multiple different signals received from the multiple satellites by the illustrated antenna system (e.g. simultaneously or otherwise), respectively split up as a function of their different orthogonal components (e.g. horizontal and vertical), with the different orthogonal components following different waveguides 10, 11 for processing. For example, vertically polarized signals may be divided out and caused to travel down one waveguide while horizontally polarized signals are divided out and caused to travel down the other waveguide. In such a manner, a user may tap into different signals from different satellites, e.g. horizontally polarized signals, vertically polarized signals, or circularly polarized signals. Also, a plurality of different satellites may be accessed simultaneously enabling a user to utilize multiple signals at the same time. Additionally, this invention may enable the user to receive signals from satellites emitting either left or right handed circularly polarized signals, as these signals are also orthogonal to one another.

While the above embodiments discuss advantages of merged Abbe Sine condition with dual focus system for use in dielectric lenses, the technique applies also to a shaped reflector fed by a single feed for each beam. This reaffirms that techniques extended to a refractive media as in a dielectric lens can also be extended to a reflective media as in a shaped reflector, as illustrated in FIGS. 28–32. One or more shaped reflectors can be applied to a multiple reflector system such as a cassegrain or newtonian. Combining of both medias (reflective and refractive) such that their composite results in the bifocal abbe sine lens condition discussed in previous embodiments has the capability to demonstrate the same off axis performance. The lensing function may be distributed by way of various designs over multiple elements, such as a main reflector, a subreflector, and/or dielectric media.

In furtherance of these reflective embodiments which may employ the same functionality and results as any of the aforesaid dielectric embodiments, FIG. 28 illustrates shaped reflector 101, multiple feeds 102 for multiple beams, multiple or multiple input LNBF(s) 103; wherein the FIG. 28 embodiments illustrates a single shaped reflector system where the reflector illustrated performs the function of the lens(es) of earlier embodiments above. Thus, the lenses may be eliminated or supplemented with the shaped reflector in this embodiment. In the FIG. 28 embodiment, the single shaped Abbe-sine reflector 101 replaces the dielectric lenses of previous embodiments herein. Additionally, feeds 102 (i.e. feedhorns) feed or illuminate the reflector. The shaped reflector (of the FIGS. 28–30 embodiments) has Abbe-sine contour so that the reflector can steer off-axis into any of the feeds. The reflector is Abbe-sine shaped so as to minimize degradation when steering off axis, thereby improving off-axis performance.

Abbe sine shaped or contoured herein means equaling or approximately equal to the known Abbe sine condition. Mathematically, the Abbe sine condition requires that:

$$y=F_e \sin\theta \tag{1}$$

The condition is fulfilled if the inner surface of a waveguide lens is spherical. Abbe sine is discussed in, for example, Antenna Handbook, Vol. II, by Y. T. Lo and S. W. Lee, pages 16–19 through 16–23, incorporated herein by reference. For a thin dielectric lens it is sufficient if the average shape of the lens is spherical. The interpretation of this condition for a thick lens is that the initial and the final ray, when extended, intersect inside the lens on a circle of radius Fe. For a given focal length and thickness there is a family of lenses that satisfy the coma-fee condition, but among these there is one for which the aperture size is a maximum, characterized by the fact that the surfaces of the lenses meet at the edge. If the dielectric constant is close to 2.6 for example, the lens can be made to nearly satisfy the Abbe sine condition even with a flat inner surface. When appropriate boundary conditions are specified, the aforesaid condition equation above and the phase constraint determine the lens (or reflector) contours. A numerical solution can be obtained by step integration of the governing equations set forth, for example, in Lo and Lee referenced above. For example, the phase constraint may be:

$$r+n[(y-r\sin\theta)^2+(x-r\cos\theta)^2]^{1/2}-X=K \tag{2}$$

where K=(n−1)T is a constant determined by the central ray as a boundary condition. Next, substitute the first equation set forth above into the immediately above equation to eliminate y. After some manipulation a quadratic equation in x can be deduced:

$$Ax^2+Bx+C=0 \tag{3}$$

where $A=\epsilon_r-1$ $B=2(r-K)-2\epsilon_r r\cos\theta$ $C=\epsilon_r r^2\cos^2\theta+\epsilon_r(F_e-r)^2\sin^2\theta-(r-K)^2$ The solution for x is $$x=\frac{-B+(B^2-4AC)^{1/2}}{2A}$$

Thus x and y can be expressed in terms of r and θ. Now Snell's law is applied to get $$\frac{dr}{d\theta}=\frac{nr\sin(\theta-\theta')}{n\cos(\theta-\theta')-1} \tag{4}$$

where $$\theta'=\tan^{-1}\left[\frac{(F_e-r)\sin\theta}{x-r\cos\theta}\right]$$

It is clear from 4 that dr/dθ is a function of r and θ only, since x and y have been replaced by 1 and 3. Thus with the central ray as an initial condition.

It should be remarked that when the Abbe-sine condition is imposed, the aperture power distribution can no longer be independently specified. In this case, as will be discussed in a later section, the aperture taper is mainly determined by the feed pattern. Hence a coma-free lens cannot provide very low side lobes if the feed pattern does not have enough illumination taper to begin with.

As mentioned previously, if a lens is very thin and its average contour is very close to a spherical surface, the lens is a wide-angle lens. As the beam is scanned and as the frequency changes, phase errors will occur across the radiating aperture. Since this lens is very thin, with its front surface radius R equal to its focal length, it obeys the Abbe-sine condition and hence has minimum coma distortions. The only remaining significant phase error is the spherical aberration which, according to Shinn, is determined by the scanning locus (focal arc) and is independent of the shape of the lens. The spherical aberration, measured as the path length error with respect to the central ray, is given by $$\delta = \frac{1}{2}\frac{y^2}{f}\left(\frac{f}{l}\cos^2 a - 1\right) + \frac{1}{2}\frac{x^2}{f}\left(\frac{f}{l} - 1\right)$$

Wide-scan capabilities can also be achieved by using bifocal systems, which are designed to have two perfect foci in the principal plane for two off-axis beams symmetrically displaced with respect to the axis. The aberrations of other beams that lie in between the limiting scans are relatively small compared with the cases where the system is designed for only one focal point on axis. The shaping technique discussed for dielectric lenses with bifocal points is different from those presented previously in that no step integration is involved and the step increments are relatively large. To completely define the surface points in between, a smoothing process of curve fitting is necessary. Due to the symmetry, only even power terms are needed. For most applications a fourth-order polynomial is sufficient. If, however, the geometry is such that the resultant step size is too large to warrant a smooth lens, this bifocal approach may not be acceptable. The other imperfection of this design is that there is a small amount of quadratic phase error in the orthogonal plane for any scan in the principal plane. This is due to the fact that the design is based on a two-dimensional analysis, whereas the actual lens is a figure of revolution of the contour generated.

FIG. 29 is a perspective view of a dual shaped reflector embodiment, which may replace the embodiment of FIG. 28. The FIG. 29 embodiment includes main shaped reflector 105, a second smaller or sub shaped reflector(s) 106 opposing the main reflector, multiple feeds 107 for multiple beams, and multiple LNBF(s) or multiple input LNB 108. This multiple shaped reflector (cassegrain) system may provide both or only one of reflectors 105, 106 as being shaped. Thus, the lenses of previous embodiments may be eliminated or supplemented with the shaped reflector(s) in this embodiment. In the FIG. 29 embodiment, the two bifocal Abbe-sine reflectors 105, 106 are shaped so that when working in conjunction with one another, they establish at least two (preferably two) approximately perfect foci in a plane, said at least two foci being approximately symmetric about an axis of an aperture of said reflector means in order to obtain an increase in off-axis performance of at least about plus/minus ten (10) beam widths with side lobes lower than about −21 dB. In other words, the two opposing reflectors in the FIG. 29 embodiment do what the bifocal Abbe-sine single shaped reflector does in the FIG. 28 embodiment. The dielectric lenses of previous embodiments are not necessary (but could be used) in the FIGS. 28–29 embodiments.

FIG. 30(*a*) is a perspective view of a dual shaped reflector embodiment with complementing dielectric lenses as described in previous embodiments, which may replace the embodiments of either FIG. 28 or FIG. 29. The FIG. 30(*a*) embodiment includes main shaped reflector 120, shaped sub-reflector 121 opposed to the main reflector, lens/waveguide/reflector feed 122 similar to those components discussed in any aforesaid embodiment, parallel plate waveguide 123, at least one dielectric lens(es) 124, multiple feeds (or ports) 125 for multiple beams, and multiple LNBs or multiple input LNB 126. In this embodiment, multiple reflectors (cassegrain), one or both shaped, are complemented by dielectric lens(es). Thus, the two shaped bifocal reflectors and lens(es) work together in the FIG. 30(*a*) embodiment to establish at least two approximately perfect foci in a plane, the at least two foci being approximately symmetric about an axis of an aperture of said reflector combined with the Abbe-sine methodology condition in order to obtain an increase in off-axis performance of at least about plus/minus ten (10) beam widths with side lobes lower than about −21 dB.

FIG. 30(*b*) illustrates a different embodiment similar to FIG. 30(*a*), that also includes OMJ 4.

FIGS. 31–32, in furtherance of the FIGS. 28–30 embodiments, are plots and tabulated data of a 31" dielectric lens performance built to the bifocal Abbe-sine condition. The data was recorded on an open air slant range at 11.7 and 12.6 GHz over scan angles of 0, 7.5, 15, 18.5 and 20 degrees as annotated. The lens test fixture is of the type shown and referred to as parallel plate TEM waveguide. Tabulated data for these Figures includes the following chart:

CHART

| Axis Position | 0° | 7.5° | 15° | 18.5° | 20° |
|---|---|---|---|---|---|
| 11.7 GHz | | | | | |
| 1st Sidelobe (dB) | 19.5 | 19.8 | 19.5 | 20.1 | 19.1 |
| 3 dB BW(°) | 1.9 | 2.0 | 2.0 | 2.1 | 2.1 |
| 2.2° Rejection (dB) | 30.3 | 28.2 | 21.1 | 18.7 | 16.6 |
| 12.6 GHz | | | | | |
| 1st Sidelobe (dB) | 21.9 | 21.2 | 18.5 | 22 | 20.3 |
| 3 dB BW(°) | 1.7 | 1.7 | 1.8 | 1.9 | 1.9 |
| 2.2° Rejection (dB) | >27.4 | >27.0 | >19.2 | 19.7 | 18.2 |

We claim:

1. A multiple beam antenna system for simultaneously receiving signals of different polarity that are orthogonal to one another, the system comprising:

means for receiving each of first and second polarized signals that are orthogonal to one another;

means for simultaneously receiving said first and second signals;

at least two feedhorns, at least one per beam, for illuminating at least one shaped bifocal Abbe-sine reflector means; and said shaped bifocal Abbe-sine reflector means for establishing at least two foci in a plane, said at least two foci being approximately symmetric about an axis of an aperture of said reflector means in order to obtain an increase in off-axis performance of at least about plus/minus ten (10) beam widths with side lobes lower than about −21 dB.

2. The antenna system of claim 1, wherein said antenna system is designed to receive satellite television signals from about 10.7–13 GHz, and wherein said system can simultaneously receive horizontally polarized signals and vertically polarized signals, and wherein said first signal is horizontally polarized and said second signal is vertically polarized.

3. The system of claim 1, further including means for simultaneously receiving both circularly polarized signals and linearly polarized signals and outputting said simultaneously received signals to a user.

4. The system of claim 1, further including means for simultaneously receiving multiple beams and multiple polarities of the circular and linear type.

5. A multiple beam antenna system comprising:

a first shaped bifocal reflector for establishing at least two approximately perfect foci in a plane, said at least two foci being approximately symmetric about an axis of an aperture of said reflector in order to obtain an increase in off-axis performance;

an orthogonal junction for receiving signals from the reflector;

wherein said junction receives energy including a first signal having a first polarity and a second signal having a second polarity from said reflective member;

wherein a signal resulting from said signal of said first polarity proceeds down a first waveguide, and a signal resulting from said signal of said second polarity proceeds down a second waveguide so that a user can receive signals of different polarity from different satellites.

6. The antenna system of claim 5, wherein said first and second polarities are substantially orthogonal to one another.

7. The antenna system of claim 5, wherein said first polarity is substantially horizontal and said second polarity is substantially vertical, and wherein said first and second waveguides are substantially parallel to one another along at least one portion thereof.

8. The antenna system of claim 5, wherein said reflective member is substantially parabolic in shape in the vertical plane and is substantially flat in the z-axis.

9. The antenna system of claim 5 wherein said first and second waveguides are substantially parallel to one another throughout their entire respective lengths, and wherein each of said waveguides is bent or angled so that first and second sections of said waveguides extend in different directions, and wherein said different directions are different from one another by an angles of from about 45 to 150 degrees.

10. The antenna system of claim 5 wherein said junction includes an elongated feed area that receives signals from said reflector.

11. The antenna system of claim 10, wherein said junction includes impedance matching steps defined by at least one wall thereof.

12. The antenna system of claim 10, wherein said junction includes a plurality of elongated members extending across a signal path that function to separate signals of different polarity from one another.

13. The antenna system of claim 12, wherein said elongated members are rods.

14. The antenna system of claim 12, wherein said junction includes a transducer for transducing a particular polarity component of a received signal into a TEM mode electromagnetic illumination of one of said waveguides.

15. The antenna system of claim 12, wherein said transducer includes a plurality of metallic transducers and said junction is made of an extruded metal.

16. The antenna system of claim 5, further including a second shaped bifocal Abbe-sine reflector for operating in conjunction with said first reflector for establishing said at least two approximately perfect foci in the plane, said at least two foci being approximately symmetric about an axis of an aperture of said reflector.

17. The antenna system of claim 16, further including first and second Abbe-sine dielectric lenses.

18. An antenna system comprising:

a shaped bifocal reflective member for establishing two approximately perfect foci relating to first and second orthogonal differently polarized received satellite beams in a plane;

an orthogonal mode junction for simultaneously receiving each of the first and second polarized signals;

said orthogonal mode junction forwarding signals of the first polarity into a first waveguide and signals of the second polarity into a second waveguide.

* * * * *